US008750760B2

(12) United States Patent
Shu

(10) Patent No.: US 8,750,760 B2
(45) Date of Patent: Jun. 10, 2014

(54) IMAGE FORMING APPARATUS AND IMAGE FORMING METHOD

(75) Inventor: Hyo Shu, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 65 days.

(21) Appl. No.: 13/168,462

(22) Filed: Jun. 24, 2011

(65) Prior Publication Data

US 2012/0014714 A1 Jan. 19, 2012

(30) Foreign Application Priority Data

Jul. 16, 2010 (JP) ..... 2010-162044

(51) Int. Cl.
*G03G 15/00* (2006.01)
*G03G 9/08* (2006.01)

(52) U.S. Cl.
USPC ..... 399/159; 430/123.52; 430/108.8; 430/109.4

(58) Field of Classification Search
USPC ..... 399/159; 430/123.52, 108.8, 109.4
See application file for complete search history.

(56) References Cited

U.S. PATENT DOCUMENTS

| | | | |
|---|---|---|---|
| 3,955,813 | A | 5/1976 | Edwards |
| 6,593,048 | B2 | 7/2003 | Sasaki et al. |
| 6,667,141 | B2 | 12/2003 | Iwamoto et al. |
| 6,699,632 | B2 | 3/2004 | Higuchi et al. |
| 6,790,575 | B2 | 9/2004 | Sasaki et al. |
| 6,811,944 | B2 | 11/2004 | Higuchi et al. |
| 6,813,461 | B2 | 11/2004 | Higuchi et al. |
| 6,835,517 | B2 | 12/2004 | Kondo et al. |
| 6,856,781 | B2 | 2/2005 | Matsuda et al. |
| 6,898,406 | B2 | 5/2005 | Suzuki et al. |
| 6,911,289 | B2 | 6/2005 | Higuchi et al. |
| 6,924,073 | B2 | 8/2005 | Higuchi et al. |
| 6,934,484 | B2 | 8/2005 | Suzuki et al. |
| 7,125,638 | B2 | 10/2006 | Suzuki et al. |
| 7,162,187 | B2 | 1/2007 | Koichi et al. |
| 7,163,774 | B2 | 1/2007 | Shiraishi et al. |

(Continued)

FOREIGN PATENT DOCUMENTS

| | | |
|---|---|---|
| JP | 57-46794 | 10/1982 |
| JP | 2005-157179 | 6/2005 |

(Continued)

OTHER PUBLICATIONS

Japanese Office Action issued in corresponding Japanese patent application No. 2010-162044 dated Jan. 28, 2014.

*Primary Examiner* — Mark A Chapman
(74) *Attorney, Agent, or Firm* — Oblon, Spivak, McClelland, Maier & Neustadt, L.L.P.

(57) ABSTRACT

An image forming apparatus including a latent electrostatic image bearing member, a latent electrostatic image forming unit, a developing unit, a transfer unit and a fixing unit, wherein the fixing unit includes rotatable heating member heating the recording medium having the unfixed visible image, rotatable pressing member coming into contact with the rotatable heating member to form a nip portion, and an air separation member separating the recording medium from the rotatable heating member by air, the toner including toner base particles each including binder resin and releasing agent, the binder resin including crystalline polyester resin and non-crystalline resin, and ratio of W/R being 0.045 to 0.85, where W denotes peak height in spectrum of the crystalline polyester resin, R denotes peak height in spectrum of the non-crystalline resin, and each of the spectra is measured by total transmission method (KBr method) using Fourier transform infrared (FT-IR) spectrometer.

19 Claims, 6 Drawing Sheets

(56) References Cited

U.S. PATENT DOCUMENTS

| | | | | |
|---|---|---|---|---|
| 7,177,555 | B2 | 2/2007 | Shu et al. | |
| 7,183,029 | B2 | 2/2007 | Masuda et al. | |
| 7,217,485 | B2 | 5/2007 | Hasegawa et al. | |
| 7,273,688 | B2 | 9/2007 | Suzuki et al. | |
| 7,515,860 | B2 | 4/2009 | Suzuki et al. | |
| 7,522,857 | B2 | 4/2009 | Hasegawa et al. | |
| 7,548,349 | B2 | 6/2009 | Koichi et al. | |
| 7,901,861 | B2 | 3/2011 | Shitara et al. | |
| 2005/0208403 | A1 | 9/2005 | Shu et al. | |
| 2006/0051692 | A1 | 3/2006 | Hasegawa et al. | |
| 2006/0057484 | A1* | 3/2006 | Tsurumi et al. | 430/108.8 |
| 2006/0068306 | A1 | 3/2006 | Shu et al. | |
| 2006/0093943 | A1 | 5/2006 | Shu et al. | |
| 2006/0240350 | A1 | 10/2006 | Shu et al. | |
| 2007/0184377 | A1 | 8/2007 | Shu et al. | |
| 2007/0217841 | A1* | 9/2007 | Fujii | 399/341 |
| 2007/0218396 | A1 | 9/2007 | Tomita | |
| 2009/0075195 | A1 | 3/2009 | Shu et al. | |
| 2009/0123186 | A1 | 5/2009 | Sugiura et al. | |
| 2009/0123857 | A1 | 5/2009 | Shu et al. | |
| 2009/0155706 | A1 | 6/2009 | Shu et al. | |
| 2009/0217568 | A1* | 9/2009 | Murphy et al. | 44/275 |
| 2009/0274492 | A1 | 11/2009 | Ishikawa | |
| 2009/0274493 | A1* | 11/2009 | Ishikawa et al. | 399/323 |
| 2009/0279928 | A1 | 11/2009 | Ishikawa | |
| 2010/0067958 | A1 | 3/2010 | Kishida et al. | |
| 2010/0068644 | A1 | 3/2010 | Nakajima et al. | |
| 2010/0136471 | A1 | 6/2010 | Yamada et al. | |
| 2010/0203441 | A1* | 8/2010 | Kataoka et al. | 430/109.4 |
| 2011/0002719 | A1 | 1/2011 | Shu et al. | |
| 2011/0033794 | A1 | 2/2011 | Watanabe et al. | |
| 2011/0091245 | A1 | 4/2011 | Shitara et al. | |
| 2011/0129773 | A1 | 6/2011 | Shu et al. | |

FOREIGN PATENT DOCUMENTS

| | | | |
|---|---|---|---|
| JP | 2007-199462 | | 8/2007 |
| JP | 2007-212922 | A | 8/2007 |
| JP | 2007-249084 | A | 9/2007 |
| JP | 2008-3277 | | 1/2008 |
| JP | 2009-020269 | A | 1/2009 |
| JP | 4284005 | | 3/2009 |
| JP | 2009-271115 | A | 11/2009 |
| JP | 2009-271345 | A | 11/2009 |

* cited by examiner

IMAGE FORMING APPARATUS AND IMAGE FORMING METHOD

BACKGROUND OF THE INVENTION

1. Field of the Invention

The present invention relates to an image forming apparatus and an image forming method which are suitably used in, for example, copiers, electrostatic printing, printers and electrostatic recording.

2. Description of the Related Art

Conventionally, heat roller fixing methods have widely been employed in devices which fix a toner image transferred onto a surface of a paper sheet in image recording apparatuses. The heat roller fixing methods heat and press paper sheet having an unfixed toner image while the paper is being held and conveyed at a nip portion formed between a fixing roller which contains a halogen heater, etc. therein and a pressing roller which presses the fixing roller.

In addition to the heat roller fixing methods, belt fixing methods have been employed. The belt fixing methods heat and press a paper sheet having an unfixed toner image while the paper sheet is being held and conveyed at a nip portion formed between an endless fixing belt and a pressing roller which presses a fixing roller via the fixing belt, where the fixing belt is wound around the fixing roller and a heating roller which contains a halogen heater, etc. therein.

In the belt fixing methods, since the heat capacity of the fixing belt is small, the warm-up time can be shortened, which is advantageous in terms of energy saving.

In these fixing methods, a toner image fused on paper is brought into contact with the fixing roller and/or the fixing belt. Thus, the fixing roller and/or the fixing belt are/is coated with a fluorine-containing resin excellent in releasing property, and a separation claw is used for the separation of a paper sheet.

The separation claw tends to scratch the surfaces of the fixing roller and the fixing belt since it comes into contact with the fixing roller and fixing belt. As a result, streaky images are output, which is considerably problematic.

In the case of monochromatic image forming apparatuses, the fixing roller is generally a roller containing a metal roller and a TEFLON (registered trademark) coating on the metal roller. Thus, even when the separation claw comes into contact with the fixing roller, the fixing roller is hardly scratched to attain a long service life. Thus, in order to prevent winding jam and other unfavorable phenomena, the separation claw has long been used.

However, in the case of color image forming apparatuses, in order to obtain good color developability, the fixing roller used is a roller whose surface layer is a fluorocoated silicone rubber (in general, a PFA tube having about several tens micrometers) or an oil-coated silicone rubber. In this configuration, the surface layer is soft to easily receive scratches, which is problematic.

Since the scratched fixing roller forms unfavorable streaky pattern on the fixed image, a contact means such as the separation claw is hardly used in color image forming apparatuses at present. Instead, non-contact separation is employed in many cases.

The non-contact separation easily causes winding jam, since paper after fixing is wound around the roller when an adhesive force between toner and fixing roller is high. Particularly in color image formation, since several color layers are stacked on top of another to increase adhesive force, winding jam is easily caused.

At present, the following methods are mainly employed for paper separation in color image forming apparatuses; (1) non-contact separation plate methods using separation plates extending in parallel with the longitudinal and width directions of a fixing roller and a fixing belt which have a small gap therebetween (about 0.2 mm to about 1 mm); (2) non-contact separation claw methods using separation claws disposed at predetermined intervals, while a small gap (about 0.2 mm to about 1 mm) is provided between a fixing roller and a fixing belt; (3) self-stripping methods in which paper is automatically peeled off due to the stiffness of the paper and the elasticity of curved regions of a fixing roller and a fixing belt.

However, since a gap is provided between the fixing roller and the fixing belt in all the above methods, a paper sheet is passed through the gap while closely adhering to the fixing roller and the fixing belt, when a thin paper sheet or a paper sheet having small blank at its top end is passed therethrough or when a solid image (e.g., a picture) is passed therethrough. As a result, winding is caused by the closely adhering, or the paper hits against the separation plate or separation claw to cause winding jam, which is problematic.

In view of this, many proposals have been made and employed on blowing air to the paper separation position for assisting the non-contact separation methods (see, for example, Japanese Patent Application Publication (JP-B) No. 57-46794, and Japanese Patent Application Laid-Open (JP-A) Nos. 2005-157179, 2007-199462 and 2008-003277). Blowing air to the paper separation position improves paper separability to prevent winding jam from occurring.

However, these proposals involve severe surface roughness of an image, especially a solid image, not attaining improvement in both paper separability and solid image quality.

Therefore, at present, demand has arisen for an image forming apparatus and an image forming method which can improve paper separability by air separation to prevent winding jam from occurring, which can prevent glossiness unevenness and solid image's surface roughness, and which can form high-quality images.

BRIEF SUMMARY OF THE INVENTION

The present invention solves the above existing problems and aims to achieve the following objects. That is, an object of the present invention is to provide an image forming apparatus and an image forming method which can improve paper separability by air separation to prevent winding jam from occurring, which can prevent the exudation of the releasing agent on the toner surface from being inhibited by air, which can prevent glossiness unevenness and solid image's surface roughness, and which can form high-quality images.

The present inventors presumed, as follows, the mechanism by which solid image's surface roughness is caused by air separation. Generally, in the process of fixing an unfixed toner solid image on a paper sheet as a result of dissolution of toner through heating and pressing by a heating roller and a pressing roller in a fixing unit, a releasing agent exudes from interior to surface of the toner to exhibit its releasing effects between toner and fixing heating roller, resulting in that an image is separated from the fixing heating roller without receiving damage on the surface thereof. However, when air is blown to the paper separation region in the fixing unit, the releasing agent is prevented from exuding from interior to surface of the toner to exhibit insufficient releasing effects on the surface of the image, resulting in that the toner on the surface of the solid image is transferred onto the heating roller when the paper is separated from the heating roller.

In order to solve the above existing problems, the present inventors conducted extensive studies and have obtained the following finding. That is, an image forming apparatus including at least a latent electrostatic image bearing member, a latent electrostatic image forming unit, a developing unit, a transfer unit and a fixing unit, wherein the fixing unit includes a rotatable heating member which heats the recording medium having the unfixed visible image, a rotatable pressing member which comes into contact with the rotatable heating member to form a nip portion, and an air separation member which separates the recording medium from the rotatable heating member by air, wherein the developing unit includes a toner containing at least a binder resin and a releasing agent, wherein the binder resin includes at least a crystalline polyester resin and a non-crystalline resin, and wherein a ratio of W/R is 0.045 to 0.85, where W denotes a peak height in a spectrum of the crystalline polyester resin, R denotes a peak height in a spectrum of the non-crystalline resin, and each of the spectra is measured by a total transmission method (KBr method) using a Fourier transform infrared (FT-IR) spectrometer can provide an image forming apparatus and an image forming method which can improve paper separability by air separation to prevent winding jam from occurring, which can prevent the exudation of the releasing agent on the toner surface from being inhibited by air, which can prevent glossiness unevenness and solid image's surface roughness, and which can form high-quality images. The present invention has been accomplished on the basis of the finding.

The present invention is based on the above findings obtained by the present inventors. Means for solving the above existing problems are as follows.

<1> An image forming apparatus including:

a latent electrostatic image bearing member, a latent electrostatic image forming unit configured to form a latent electrostatic image on the latent electrostatic image bearing member, a developing unit configured to develop the latent electrostatic image with a toner to form a visible image, a transfer unit configured to transfer the visible image onto the recording medium, and a fixing unit configured to fix the transferred visible image on a recording medium, wherein the fixing unit includes a rotatable heating member which heats the recording medium having the unfixed visible image, a rotatable pressing member which comes into contact with the rotatable heating member to form a nip portion, and an air separation member which separates the recording medium from the rotatable heating member by air, wherein the toner includes toner base particles each containing at least a binder resin and a releasing agent, wherein the binder resin includes at least a crystalline polyester resin and a non-crystalline resin, and wherein a ratio of W/R is 0.045 to 0.85, where W denotes a peak height in a spectrum of the crystalline polyester resin, R denotes a peak height in a spectrum of the non-crystalline resin, and each of the spectra is measured by a total transmission method (KBr method) using a Fourier transform infrared (FT-IR) spectrometer.

<2> The image forming apparatus according to <1>, wherein the releasing agent is a microcrystalline wax of a C20-C80 hydrocarbon containing a linear hydrocarbon in an amount of 55% by mass to 70% by mass, and has a melting point of 65° C. to 90° C. where the melting point is defined as a maximum endothermic peak temperature measured through differential scanning calorimetry (DSC).

<3> The image forming apparatus according to <1> or <2>, wherein the releasing agent is contained in an amount of 1% by mass to 20% by mass relative to a total amount of the toner base particles.

<4> The image forming apparatus according to any one of <1> to <3>, wherein the crystalline polyester resin has a melting point of 50° C. to 150° C. where the melting point is defined as a maximum endothermic peak temperature measured through differential scanning calorimetry (DSC).

<5> The image forming apparatus according to any one of <1> to <4>, wherein the toner is obtained by a production method including:

dissolving or dispersing in an organic solvent toner materials containing at least the binder resin and the releasing agent to prepare a toner material liquid which is an oil phase, and emulsifying or dispersing the oil phase in an aqueous medium which is an aqueous phase, and removing the organic solvent to form the toner base particles.

<6> An image forming method including:

forming a latent electrostatic image on a latent electrostatic image bearing member, developing the latent electrostatic image with a toner to form a visible image, transferring the visible image onto a recording medium, and fixing the transferred visible image on the recording medium, the fixing is performed with a fixing unit including a rotatable heating member which heats the recording medium having the unfixed visible image, a rotatable pressing member which comes into contact with the rotatable heating member to form a nip portion, and an air separation member which separates the recording medium from the rotatable heating member by air, wherein the toner includes toner base particles each containing at least a binder resin and a releasing agent, wherein the binder resin includes at least a crystalline polyester resin and a non-crystalline resin, and wherein a ratio of W/R is 0.045 to 0.85, where W denotes a peak height in a spectrum of the crystalline polyester resin, R denotes a peak height in a spectrum of the non-crystalline resin, and each of the spectra is measured by a total transmission method (KBr method) using a Fourier transform infrared (FT-IR) spectrometer.

<7> The image forming method according to <6>, wherein the releasing agent is a microcrystalline wax of a C20-C80 hydrocarbon containing a linear hydrocarbon in an amount of 55% by mass to 70% by mass, and has a melting point of 65° C. to 90° C. where the melting point is defined as a maximum endothermic peak temperature measured through differential scanning calorimetry (DSC).

<8> The image forming method according to <6> or <7>, wherein the releasing agent is contained in an amount of 1% by mass to 20% by mass relative to a total amount of the toner base particles.

<9> The image forming method according to any one of <6> to <8>, wherein the crystalline polyester resin has a melting point of 50° C. to 150° C. where the melting point is defined as a maximum endothermic peak temperature measured through differential scanning calorimetry (DSC).

<10> The image forming method according to any one of <6> to <9>, wherein the toner is obtained by a production method including:

dissolving or dispersing in an organic solvent toner materials containing at least the binder resin and the releasing agent to prepare a toner material liquid which is an oil phase, and emulsifying or dispersing the oil phase in an aqueous medium which is an aqueous phase, and removing the organic solvent to form the toner base particles.

The present invention can provide an image forming apparatus and an image forming method which can improve paper separability by air separation to prevent winding jam from occurring, which can prevent the exudation of the releasing agent on the toner surface from being inhibited by air, which can prevent glossiness unevenness and solid image's surface roughness, and which can form high-quality images. These can solve the above existing problems and achieve the above objects.

Figure 1:
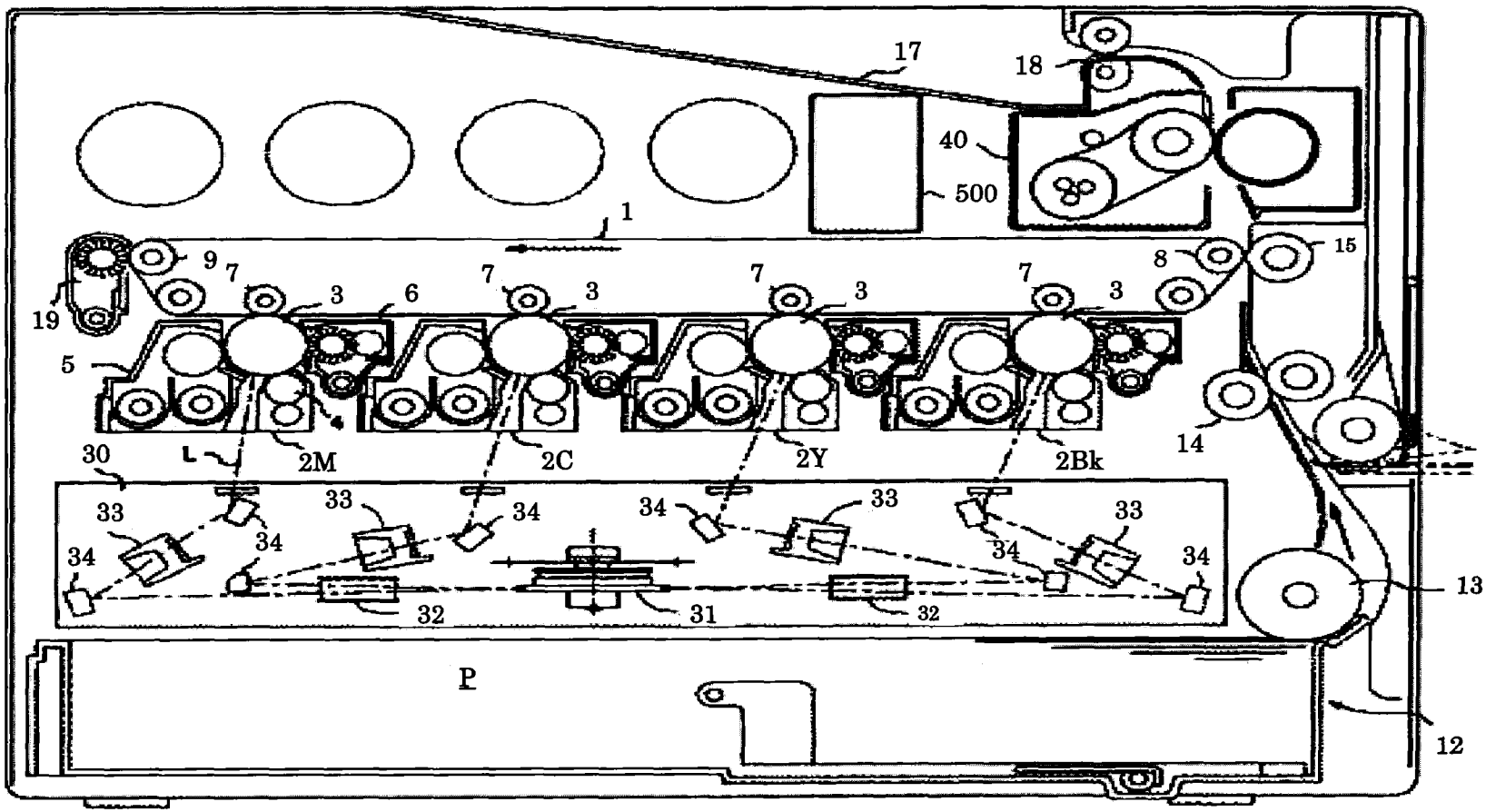
FIG. 1 is a cross-sectional view of one exemplary image forming apparatus according to the present invention.

DETAILED DESCRIPTION OF THE INVENTION (Image Forming Apparatus and Image Forming Method)

An image forming apparatus of the present invention includes at least a latent electrostatic image bearing member, a latent electrostatic image forming unit, a developing unit, a transfer unit and a fixing unit; and, if necessary, further includes other units such as a charge-eliminating unit, a cleaning unit, a recycling unit and a controlling unit.

An image forming method of the present invention includes at least a latent electrostatic image forming step, a developing step, a transfer step and a fixing step; and, if necessary, further includes other steps such as a charge-eliminating step, a cleaning step, a recycling step an a controlling step.

The image forming method of the present invention can be suitably performed by the image forming apparatus of the present invention. Specifically, the latent electrostatic image forming step can be performed by the latent electrostatic image forming unit. The developing step can be performed by the developing unit. The transfer step can be performed by the transfer unit. The fixing step can be performed by the fixing unit. The other steps can be performed by the other units.

<Latent Electrostatic Image Forming Step and Latent Electrostatic Image Forming Unit>

The latent electrostatic image forming step is a step of forming a latent electrostatic image on the latent electrostatic image bearing member.

The material, shape, structure, size, etc. of the latent electrostatic image bearing member (hereinafter may be referred to as "photoconductor" or "image bearing member") are not particularly limited and may be appropriately selected from those known in the art. Regarding the shape, the latent image bearing member is suitably in the form of a drum. Regarding the material, the latent image bearing member is, for example, an inorganic photoconductor made of amorphous silicon, selenium or the like and an organic photoconductor made of polysilane, phthalopolymethine or the like. Of these, an amorphous silicon photoconductor is preferred since it has a long service life.

The amorphous silicon photoconductor may be, for example, a photoconductor having a support and a photoconductive layer of a-Si, which is formed on the support heated to 50° C. to 400° C. with a film forming method such as vacuum vapor deposition, sputtering, ion plating, thermal CVD, photo-CVD or plasma CVD (hereinafter this photoconductor may be referred to as "a-Si photoconductor"). Of these, plasma CVD is suitably employed, in which gaseous raw materials are decomposed through application of direct current or high-frequency or microwave glow discharge to form an a-Si deposition film on the support.

The latent electrostatic image can be formed using the latent electrostatic image forming unit by charging a surface of the photoconductor and imagewise exposing the charged surface thereof.

The latent electrostatic image forming unit has a charging unit configured to charge the photoconductor surface and an exposing unit configured to imagewise expose the charged photoconductor surface.

<<Charging Unit>>

The above charging can be performed by, for example, applying voltage to the photoconductor surface using a charging unit.

The charging unit is not particularly limited and may be appropriately selected depending on the intended purpose. Examples thereof include contact-type chargers known per se having, for example, a conductive or semiconductive roller, brush, film and rubber blade; and non-contact-type chargers utilizing colona discharge such as corotron and scorotron.

The charging unit may have any shape like a charging roller as well as a magnetic brush, a fur brush, etc. The shape thereof may be suitably selected according to the specification or configuration of the electrophotographic apparatus.

When the magnetic brush is used as the charging unit, the magnetic brush is composed of a charging means of various ferrite particles such as Zn—Cu ferrite, a non-magnetic conductive sleeve to support the ferrite particles, and a magnetic roller included in the non-magnetic conductive sleeve.

Also, when the fur brush is used as the charging unit, the fur brush may be a fur which is treated to be conductive with, for example, carbon, copper sulfide, a metal or a metal oxide as well as which is coiled around or mounted to a metal or a metal core treated to be conductive.

The charging unit is not limited to the aforementioned contact-type charging units. However, the contact-type charging units are preferably used from the viewpoint of producing an image forming apparatus in which the amount of ozone generated from the charging unit is reduced.

<<Exposing Unit>>

The charged electrophotographic photoconductor surface can be imagewise exposed to light, for example, using the exposing device.

The exposing device is not particularly limited, so long as it attains desired imagewise exposure on the surface of the photoconductor charged with the charging unit, and may be appropriately selected depending on the purpose. Examples of the exposing unit include various exposing units such as a copy optical exposing device, a rod lens array exposing device, a laser optical exposing device and a liquid crystal shutter exposing device.

A light source used for the exposing unit is not particularly limited and may be appropriately selected depending on the intended purpose. Examples thereof include usual light-emitting devices such as a fluorescent lamp, a tungsten lamp, a halogen lamp, a mercury lamp, a sodium lamp, a light-emitting diode (LED), a laser diode (LD) and an electroluminescence (EL) device.

Also, a filter may be used for applying light having a desired wavelength. The filter may be various filters such as sharp-cut filter, a band-pass filter, an infrared cut filter, a dichroic filter, an interference filter and a color conversion filter.

In the present invention, light may be imagewise applied from the side facing the photoconductor support.

<Developing Step and Developing Unit>

The developing step is a step of developing the latent electrostatic image with a toner or developer to form a visible image.

The visible image can be formed with the developing unit by, for example, developing the latent electrostatic image using the toner or developer.

The developing unit is not particularly limited, so long as it attains developing with the toner or developer, and may be appropriately selected from known developing units. Examples of preferred developing units include those having a developing device which has the toner or developer therein and which can apply the toner or developer to the latent electrostatic image in a contact or non-contact manner.

The above developing device may employ a dry or wet developing process, and may be a single-color or multi-color developing device. Examples of preferred developing devices include those having a rotatable magnetic roller and a stirrer for charging the toner or developer with friction caused during stirring.

In the developing device, toner particles and carrier particles are stirred and mixed so that the toner particles are charged by friction generated therebetween. The charged toner particles are retained in the chain-like form on the surface of the rotating magnetic roller to form a magnetic brush. The magnetic roller is disposed proximately to the photoconductor and thus, some of the toner particles forming the magnetic brush on the magnet roller are electrically transferred onto the photoconductor surface. As a result, the latent electrostatic image is developed with the toner particles to form a visual toner image on the photoconductor surface.

<<Toner>>

The toner includes toner base particles each containing at least a binder resin and a releasing agent; and, if necessary, further includes other ingredients such as a colorant, a charge-controlling agent, fine resin particles and external additives.

<<<Binder Resin>>>

The binder resin (hereinafter may be referred to as "toner binder") contains at least a crystalline polyester resin and a non-crystalline resin; and, if necessary, further includes other ingredients.

—Crystalline Polyester Resin—

The crystalline polyester resin can be produced through reaction between an alcohol component and an acid component, and is a polyester having at least a melting point. The toner contains such a crystalline polyester resin and thus, the releasing agent easily exudes from the interior of the toner. This is advantageous in that the obtained releasing effect can improve glossiness unevenness and solid image's surface roughness.

The alcohol component is not particularly limited and may be appropriately selected depending on the intended purpose. For example, C2-C6 diol compounds are preferably used as the alcohol component. These may be used alone or in combination. Of these, the alcohol component is particularly preferably 1,4-butanediol, 1,6-hexanediol or a derivative of them.

The acid component is not particularly limited and may be appropriately selected depending on the intended purpose. It preferably contains at least one selected from maleic acid, fumaric acid, succinic acid and derivatives of these acids.

The crystalline polyester resin is particularly preferably a crystalline polyester resin having a structural repeating unit represented by the following General Formula (1) and synthesized from the above alcohol component and the above acid component.

$$\text{+O—CO—CR}_1\text{=CR}_2\text{—CO—O—(CH}_2\text{)}_n\text{+} \quad \text{General Formula (1)}$$

where $R_1$ and $R_2$ each represent a hydrogen atom or a C2-C20, preferably C2-C4, hydrocarbon group, and n is an integer of 2 to 20, preferably 2 to 6.

The method for controlling the crystallinity and softening point of the crystalline polyester resin is not particularly limited and may be appropriately selected depending on the intended purpose. For example, the molecule of non-linear polyesters or the like is appropriately designed.

The method for synthesizing the non-linear polyester is not particularly limited and may be appropriately selected depending on the intended purpose. Examples thereof include condensation polymerization between the alcohol component containing a tri or higher polyhydric alcohol (e.g., glycerin) and the acid component containing a tri or higher polycarboxylic acid (e.g., trimellitic anhydride).

The molecular structure of the crystalline polyester resin can be confirmed through, for example, solid NMR.

The molecular weight of the crystalline polyester resin is not particularly limited and may be appropriately selected depending on the intended purpose. The crystalline polyester resin preferably has a sharp molecular weight distribution and a low molecular weight, since it is excellent in low-temperature fixing property. More preferably, in a molecular weight distribution diagram obtained through gel permeation chromatography (GPC) of the soluble matter of a sample in o-dichlorobenzene where the horizontal axis indicates log (M) and the vertical axis indicates % by mass, the peak is in the range of 3.5 to 4.0 and the half width of the peak is 1.5 or less. In addition, the weight average molecular weight (Mw) is 1,000 to 6,500, the number average molecular weight (Mn) is 500 to 2,000, and the Mw/Mn is 2 to 5.

The molecular weight can be measured through gel permeation chromatography (GPC) as follows.

Specifically, first, a column is conditioned in a heat chamber at 40° C. Then, tetrahydrofuran (THF) (serving as a solvent) is caused to pass through the column at a flow rate of 1 mL/min while the temperature is being maintained. Subsequently, a separately prepared tetrahydrofuran solution of a resin sample (concentration; 0.05% by mass to 0.6% by mass) is applied to the column in an amount of 50 μL to 200 μL. In the measurement of the molecular weight of the sample, the molecular weight distribution is determined based on the relationship between the logarithmic value and the count number of a calibration curve given by using several monodisperse polystyrene-standard samples. The standard polystyrenes used for giving the calibration curve may be, for example, those available from Pressure Chemical Co. or Tosoh Co.; i.e., those each having a molecular weight of $6\times10^2$, $2.1\times10^2$, $4\times10^2$, $1.75\times10^4$, $1.1\times10^5$, $3.9\times10^5$, $8.6\times10^5$, $2\times10^6$ and $4.48\times10^6$. Preferably, at least about 10 standard polystyrenes are used for giving the calibration curve. The detector usable is a refractive index (RI) detector.

In the toner base particles, the average dispersion particle diameter of the crystalline polyester resin is not particularly limited and may be appropriately selected depending on the intended purpose. The average dispersion particle diameter thereof is preferably 0.2 μm to 3.0 μm in terms of the average diameter of the major axes. When the average diameter of the major axes is adjusted so as to fall the range of 0.2 μm to 3.0 μm, the releasing agent can be finely dispersed in the toner base particles. As a result, the releasing agent can be prevented from being localized in the surfaces of the toner base particles, which is preferred.

Here, the "average dispersion particle diameter of the crystalline polyester resin" refers to a volume average particle diameter of the crystalline polyester resin, which is measured in the toner base particles containing the crystalline polyester resin dispersed in a dispersion medium such as an organic solvent. For example, when a releasing agent and a binder resin are added to an oil phase in the form of dispersion liquid or kneaded mixture (master batch) during the production of a toner, their volume average particle diameter can be measured in the dispersion liquid or kneaded mixture. Notably, the measuring method of the average dispersion particle diameter will be described in detail in the below Examples.

The acid value of the crystalline polyester resin is not particularly limited and may be appropriately selected depending on the intended purpose. The acid value thereof is preferably 8 mgKOH/g to 45 mgKOH/g, more preferably 20 mgKOH/g to 45 mgKOH/g. In terms of compatibility between recording media and the crystalline polyester resin, in order to attain desired low-temperature fixing property, the acid value thereof is preferably 8 mgKOH/g or higher, more preferably 20 mgKOH/g or higher. In order to improve hot offset property, the acid value thereof is preferably 45 mgKOH/g or lower.

The acid value can be measured by, for example, the measurement method described in JIS K0070-1992 as follows. Specifically, a sample solution is titrated with a pre-standardized N/10 potassium hydroxide alcohol solution and then the acid value is calculated from the amount of the potassium hydroxide alcohol solution consumed using the following equation:

$$\text{Acid value}=\text{KOH(mL)}\times N\times 56.1/\text{mass of sample}$$

where N is a factor of N/10 KOH.

Also, the hydroxyl value of the crystalline polyester resin is not particularly limited and may be appropriately selected depending on the intended purpose. In order to attain desired low-temperature fixing property and excellent charging property, the hydroxyl value thereof is preferably 0 mgKOH/g to 50 mgKOH/g, more preferably 5 mgKOH/g to 50 mgKOH/g.

The hydroxyl value can be measured by, for example, the measurement method described in JIS K0070-1992 as follows. Specifically, a sample of 0.5 g is precisely weighed and placed in a 100 mL-measuring flask. An acetylating reagent (5 mL) is precisely added to the flask, followed by heating in a hot-water bath at 100° C.±5° C. One to two hours after, the flask is taken out from the bath and is left to cool in air, followed by addition of water. The flask is swung to decompose the acetic anhydride. In order for the acetic anhydride to thoroughly decompose, the flask is placed again in the bath and heated for 10 min or longer, followed by cooling in air. Subsequently, the wall of the flask is thoroughly washed with an organic solvent. The resultant liquid is subjected to potentiometric titration using an electrode and an N/2 solution of potassium hydroxide in ethyl alcohol, to thereby determine an OH value of the sample (according to JIS K0070-1966).

The melting point of the crystalline polyester resin is not particularly limited and may be appropriately selected depending on the intended purpose. In a differential scanning calorimetry curve obtained through differential scanning calorimetry (DSC), the temperature at which the endothermic peak, where the amount of heat absorbed becomes maximum, is observed (hereinafter the temperature may be referred to as "maximum endothermic peak temperature") is preferably 50° C. to 150° C., more preferably 80° C. to 125° C. When the melting point is lower than 50° C., the obtained toner is degraded in heat resistance storage stability, so that it may be hardened during storage to be poor in flowability. When the melting point exceeds 150° C., the releasing agent cannot be finely dispersed during fixing, resulting in that the releasing agent cannot exhibit its releasing effects on the surface of an image, not preventing staining. As a result, glossiness unevenness and solid image's surface roughness may occur.

The amount of the crystalline polyester resin contained in the binder resin is not particularly limited and may be appropriately selected depending on the intended purpose. The amount of the crystalline polyester resin is preferably 2% by mass to 60% by mass, more preferably 5% by mass to 20% by mass, still more preferably 5% by mass to 15% by mass. When it is less than 2% by mass, low-temperature fixing property may be degraded as well as glossiness unevenness and solid image's surface roughness may occur. When it exceeds 60% by mass, storage stability may be degraded.

—Non-Crystalline Resin—

The non-crystalline (amorphous) resin is not particularly limited and may be appropriately selected depending on the intended purpose. Examples thereof include modified polyester resins containing at least an ester bond and a binding unit other than the ester bond, and polyester resins that are not modified (hereinafter may be referred to as "unmodified modified polyester resin"). Further, binder resin precursors capable of forming the modified polyester resins may be used. These may be used alone or in combination.

The weight average molecular weight of the non-crystalline resin is not particularly limited and may be appropriately selected depending on the intended purpose. It is preferably 1,000 or higher, more preferably 2,000 to 10,000,000, particularly preferably 3,000 to 1,000,000.

When the weight average molecular weight is lower than 1,000, glossiness unevenness and solid image's surface roughness may occur.

The weight average molecular weight of the non-crystalline resin can be measured by the same method as that used for measuring the molecular weight of the crystalline polyester.

The amount of the non-crystalline resin contained in the binder resin is not particularly limited and may be appropriately selected depending on the intended purpose. It is preferably 40% by mass to 98% by mass, more preferably 80% by mass to 95% by mass, still more preferably 85% by mass to 95% by mass. When the amount of the non-crystalline polyester resin is less than 40% by mass, storage stability may be degraded. Whereas when it exceeds 98% by mass, fixing property may be degraded as well as glossiness unevenness and solid image's surface roughness may occur.

—Modified Polyester Resin—

The modified polyester resin is not particularly limited and may be appropriately selected depending on the intended purpose. The modified polyester resin preferably contains a compound having an active hydrogen-containing group and a polyester resin having a functional group reactive with the active hydrogen-containing group of the compound.

—Compound Having Active Hydrogen-Containing Group—

The compound having an active hydrogen-containing group serves as, for example, an elongating agent and a crosslinking agent in, for example, elongation reaction and crosslinking reaction, in an aqueous medium, of a polyester resin containing a functional group reactive with the compound having an active hydrogen-containing group.

The compound having an active hydrogen-containing group is not particularly limited, so long as it has an active hydrogen-containing group, and may be appropriately selected depending on the purpose. For example, when the polyester resin having a functional group reactive with the compound having an active hydrogen-containing group is an isocyanate group-containing polyester prepolymer (A), an amine (B) is preferably used as the compound having an active hydrogen-containing group, since it can provide a high-molecular-weight product through reactions of elongation, crosslinking, etc. with the isocyanate group-containing modified polyester (A).

The active hydrogen-containing group is not particularly limited and may be appropriately selected depending on the intended purpose. Examples thereof include a hydroxyl group (alcoholic or phenolic hydroxyl group), an amino group, a carboxyl group and a mercapto group. These may be used alone or in combination. Among them, an alcoholic hydroxyl group is particularly preferred.

The amine (B) is not particularly limited and can be appropriately selected depending on the intended purpose. Examples thereof include diamines (B1), tri- or more-valent polyamines (B2), amino alcohols (B3), aminomercaptans (B4), amino acids (B5), and amino-blocked products (B6) of amines (B1) to (B5). These may be used alone or in combination.

Among them, particularly preferred are diamine (B1) and a mixture of diamine (B1) and a small amount of tri- or more-valent amine (B2).

Diamine (B1) is not particularly limited and may be appropriately selected depending on the intended purpose. Examples thereof include aromatic diamines, alicyclic diamines and aliphatic diamines. Examples of the aromatic diamine include phenylenediamine, diethyltoluenediamine and 4,4'-diaminodiphenylmethane. Examples of the alicyclic diamine include 4,4'-diamino-3,3'-dimethyldicyclohexylmethane, diaminecyclohexane and isophoronediamine. Examples of the aliphatic diamines include ethylenediamine, tetramethylenediamine and hexamethylenediamine.

The tri- or more-valent polyamine (B2) is not particularly limited and may be appropriately selected depending on the intended purpose. Examples thereof include diethylenetriamine and triethylenetetramine.

The amino alcohol (B3) is not particularly limited and may be appropriately selected depending on the intended purpose. Examples thereof include ethanolamine and hydroxyethylaniline.

The aminomercaptan (B4) is not particularly limited and may be appropriately selected depending on the intended purpose. Examples thereof include aminoethyl mercaptan and aminopropyl mercaptan.

The amino acid (B5) is not particularly limited and may be appropriately selected depending on the intended purpose. Examples thereof include aminopropionic acid and aminocaproic acid.

The amino-blocked product (B6) is not particularly limited and may be appropriately selected depending on the intended purpose. Examples thereof include ketimine compounds and oxazolidine compounds derived from the amines (B1) to (B5) and ketones (e.g., acetone, methyl ethyl ketone and methyl isobutyl ketone).

—Functional Group Reactive with Active Hydrogen-Containing Group—

The polyester resin having a functional group reactive with the active hydrogen-containing group (hereinafter may be referred to as "polyester prepolymer (A)") is not particularly limited, so long as it has at least a site reactive with the compound having the active hydrogen-containing group, and may be appropriately selected depending on the intended purpose. Examples thereof include polyol resins, polyacryl resins, polyester resins, epoxy resins and derivatives thereof. These may be used alone or in combination.

Among them, polyester resins are particularly preferred from the viewpoints of high flowability upon melting and high transparency.

The functional group reactive with the active hydrogen-containing group in the polyester prepolymer (A) is not particularly limited and may be appropriately selected from known substituents. Examples thereof include an isocyanate group, an epoxy group, a carboxyl group and an acid chloride group. These may be used alone or in combination.

Among them, an isocyanate group is particularly preferably used as the functional group reactive with the active hydrogen-containing group.

The method for producing the polyester prepolymer (A) containing an isocyanate group is not particularly limited and may be appropriately selected depending on the intended purpose. The method for producing the polyester prepolymer (A) is, for example, the below-described method. Specifically, a polyol (A1) and a polycarboxylic acid (A2) are allowed to react together under heating to 150° C. to 280° C. in the presence of a known esterification catalyst such as tetrabutoxytitanate or dibutyltinoxide, optionally while the pressure is being reduced as appropriate. Then, water is removed to obtain a polyester having a hydroxyl group. Subsequently, the obtained polyester is reacted with a polyisocyanate (A3) at 40° C. to 140° C.

The polyol (A1) is not particularly limited and may be appropriately selected depending on the intended purpose. Examples thereof include diols, trihydric or higher polyols, and mixtures of diols and trihydric or higher polyols. These may be used alone or in combination. Among them, the polyol is preferably diols and mixtures of diols and a small amount of trihydric or higher polyols.

The diol is not particularly limited and may be appropriately selected depending on the intended purpose. Examples thereof include alkylene glycols (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexane dimethanol and hydrogenated bisphenol A); bisphenols (e.g., bisphenol A, bisphenol F and bisphenol S); adducts of the above-listed alicyclic diols with alkylene oxides (e.g., ethylene oxide, propylene oxide and butylene oxide); and adducts of the above-listed bisphenols with alkylene oxides (e.g., ethylene oxide, propylene oxide and butylene oxide). These may be used alone or in combination.

Among them, the diol is preferably C2-C12 alkylene glycols and adducts of the bisphenols with alkylene oxides (e.g., bisphenol A ethylene oxide 2 mol adduct, bisphenol A propylene oxide 2 mol adduct and bisphenol A propylene oxide 3 mol adduct).

The trihydric or higher polyol is not particularly limited and may be appropriately selected depending on the intended purpose. Examples thereof include polyvalent aliphatic alcohols (e.g., glycerin, trimethylolethane, trimethylolpropane, pentaerythritol and sorbitol); trihydric or higher phenols (e.g., phenol novolak and cresol novolak); and adducts of trihydric or higher polyphenols with alkylene oxides. These may be used alone or in combination.

In the mixture of the diol and the trihydric or higher polyol, the mixing ratio by mass of the diol and the trihydric or higher polyol (diol trihydric or higher polyol) is not particularly limited and may be appropriately selected depending on the intended purpose. It is preferably 100:0.01 to 100:10, more preferably 100:0.01 to 100:1.

The polycarboxylic acid (A2) is not particularly limited and may be appropriately selected depending on the intended purpose. Examples thereof include alkylene dicarboxylic acids (e.g., succinic acid, adipic acid and sebacic acid); alkenylene dicarboxylic acids (e.g., maleic acid and fumaric acid); and aromatic dicarboxylic acids (e.g., terephthalic acid, isophthalic acid and naphthalene dicarboxylic acid). These may be used alone or in combination. Among them, the polycarboxylic acid (A2) is preferably C4-C20 alkenylene dicarboxylic acids and C8-C20 aromatic dicarboxylic acids.

The trihydric or higher polycarboxylic acid is not particularly limited and may be appropriately selected depending on the intended purpose. Examples thereof include C9-C20 aromatic polycarboxylic acid (e.g., trimellitic acid and pyromellitic acid). These may be used alone or in combination.

Notably, instead of the polycarboxylic acid, polycarboxylic anhydrides or lower alkyl esters may be used. The lower alkyl ester is not particularly limited and may be appropriately selected depending on the intended purpose. Examples thereof include methyl ester, ethyl ester and isopropyl ester.

The polyisocyanate (A3) is not particularly limited and may be appropriately selected depending on the intended purpose. Examples thereof include aliphatic polyisocyanates, alicyclic polyisocyanates, aromatic diisocyanate s, aromatic aliphatic diisocyanate, isocyanurates, phenol derivatives thereof and blocked products thereof with, for example, oxime and caprolactam.

The aliphatic polyisocyanate is not particularly limited and may be appropriately selected depending on the intended purpose. Examples thereof include tetramethylene diisocyanate, hexamethylene diisocyanate, 2,6-diisocyanatomethylcaproate, octamethylene diisocyanate, decamethylene diisocyanate, dodecamethylene diisocyanate, tetradecamethylene diisocyanate, trimethylhexane diisocyanate and tetramethylhexane diisocyanate.

The alicyclic polyisocyanate is not particularly limited and may be appropriately selected depending on the intended purpose. Examples thereof include isophoron diisocyanate and cyclohexylmethane diisocyanate.

The aromatic diisocyanate is not particularly limited and may be appropriately selected depending on the intended purpose. Examples thereof include tolylene diisocyanate, diphenylmethane diisocyanate, 1,5-naphthylene diisocyanate, diphenylene-4,4'-diisocyanate, 4,4'-diisocyanato-3,3'-dimethyldiphenyl, 3-methyldiphenylmethane-4,4'-diisocyanate and diphenylether-4,4'-diisocyanate.

The aromatic aliphatic diisocyanate is not particularly limited and may be appropriately selected depending on the intended purpose. Examples thereof include α,α, α', α'-tetramethylxylylene diisocyanate.

The isocyanurate is not particularly limited and may be appropriately selected depending on the intended purpose. Examples thereof include tris-isocyanatoalkyl-isocyanurate and triisocyanatoalkyl-isocyanurate.

These may be used alone or in combination.

The isocyanate group-containing polyester prepolymer (A) preferably has, in one molecule thereof, one or more isocyanate groups on average, more preferably 1.2 groups to 5 groups on average, still more preferably 1.5 groups to 4 groups on average.

When the average number of the isocyanate groups is less than one per one molecule, the molecular weight of the modified polyester resin decreases, resulting in that the formed toner may be degraded in hot offset fixing property and storage stability.

The weight average molecular weight (Mw) of the polyester resin having a functional group reactive with the compound having an active hydrogen-containing group can be determined based on the molecular weight distribution obtained by analyzing tetrahydrofuran (THF) soluble matter of the polyester resin through gel permeation chromatography (GPC). It is preferably 1,000 to 30,000, more preferably 1,500 to 15,000. When the weight average molecular weight (Mw) is lower than 1,000, the formed toner may be degraded in heat resistance storage stability; whereas when the Mw is higher than 30,000, the formed toner may be degraded in low-temperature fixing property.

The weight average molecular weight of the polyester resin having a functional group reactive with the compound having an active hydrogen-containing group can be measured with the same measurement method of the molecular weight of the polyester.

The modified polyester resin can be obtained by reacting the compound having an active hydrogen-containing group (e.g., the above amines (B)), in an aqueous medium, with the polyester resin having a functional group reactive with the compound having an active hydrogen-containing group (e.g., the above polyester prepolymers (A)).

A solvent is optionally used in reacting the amine (B) with the polyisocyanate (A3).

The solvent usable is not particularly limited and may be appropriately selected depending on the intended purpose. Examples thereof include solvents inert with respect to the polyisocyanate (A3). Specific examples include aromatic solvents (e.g., toluene and xylene), ketones (e.g., acetone, methyl ethyl ketone and methyl isobutyl ketone), esters (e.g., ethyl acetate), amides (e.g., dimethylformamide and dimethylacetamide) and ethers (e.g., tetrahydrofuran). These may be used alone or in combination.

The mixing ratio of the amine (B) and the polyester prepolymer (A) having an isocyanate group is preferably 1/3 to 3/1, more preferably 1/2 to 2/1, particularly preferably 1/1.5 to 1.5/1, in terms of the equivalent ratio ([NCO]/[NHx]) of isocyanate group [NCO] in the polyester prepolymer (A) having an isocyanate group to amino group [NHx] in the amine (B).

When the equivalent ratio ([NCO]/[NHx]) is less than ⅓, low-temperature fixing property may be degraded. Whereas when the equivalent ratio ([NCO]/[NHx]) exceeds 3/1, the molecular weight of the modified polyester resin may decrease to roughness the surface of an image.

Also, a reaction terminator can be used for terminating elongation/crosslinking reaction between the compound having an active hydrogen-containing group and the polyester resin having a functional group reactive with the compound having an active hydrogen-containing group. Use of the reaction terminator is preferred, since the molecular weight of the non-crystalline resin can be adjusted to fall within the desired range.

The reaction terminator is not particularly limited and may be appropriately selected depending on the intended purpose. Examples thereof include monoamines (e.g., diethyl amine, dibutyl amine, butyl amine and lauryl amine) and blocked products thereof (e.g., ketimine compounds). These may be used alone or in combination.

—Unmodified Polyester Resin—

The unmodified polyester resin is not particularly limited and may be appropriately selected depending on the intended purpose. Examples thereof include unmodified polyester resins containing a compound having an active hydrogen-containing group and a polyester resin having a functional group reactive with the active hydrogen-containing group of the compound. The method for producing the unmodified polyester resin is not particularly limited and may be appropriately selected depending on the intended purpose. Examples thereof include a method in which the unmodified polyester resin is produced in the same manner as in the compound having an active hydrogen-containing group and then, if necessary, is dissolved in the above solvent and stirred.

The weight average molecular weight (Mw) of the unmodified polyester resin can be determined based on the molecular weight distribution obtained by analyzing tetrahydrofuran (THF) soluble matter of the unmodified polyester resin through gel permeation chromatography (GPC). It is preferably 1,000 to 30,000, more preferably 1,500 to 15,000. When the weight average molecular weight (Mw) is lower than 1,000, the formed toner may be degraded in heat resistance storage stability; whereas when the Mw is higher than 30,000, the formed toner may be degraded in low-temperature fixing property.

The acid value of the unmodified polyester resin is preferably 1.0 mgKOH/g to 50.0 mgKOH/g, more preferably 1.0 mgKOH/g to 45.0 mgKOH/g, still more preferably 15.0 mgKOH/g to 45.0 mgKOH/g. In general, when the toner has an acid value, the toner is easily negatively charged.

The hydroxyl value of the unmodified polyester resin is not particularly limited and may be appropriately selected depending on the intended purpose. It is preferably 5 mgKOH/g or higher, more preferably 10 mgKOH/g to 120 mgKOH/g, still more preferably 20 mgKOH/g to 80 mgKOH/g. When the hydroxyl value thereof is lower than 5 mgKOH/g, it may be difficult for the formed toner to have both good heat resistance storage stability and good low-temperature fixing property.

When the unmodified polyester resin is contained in the toner material, the mixing ratio by mass of the modified polyester resin to the unmodified polyester resin (i.e., modified polyester resin/unmodified polyester resin) is not particularly limited and may be appropriately selected depending on the intended purpose. It is preferably 5/95 to 80/20, more preferably 10/90 to 25/75. When the rate of the unmodified polyester resin in the mixing ratio by mass exceeds 95, it may be difficult for the formed toner to have both good heat resistance storage stability and good low-temperature fixing property. Whereas when the rate of the unmodified polyester resin in the mixing ratio by mass is lower than 20, glossiness unevenness and solid image's surface roughness may occur.

The amount of the unmodified polyester resin contained in the binder resin is not particularly limited and may be appropriately selected depending on the intended purpose. It is preferably 50% by mass to 100% by mass, more preferably 70% by mass to 95% by mass, still more preferably 80% by mass to 90% by mass. When the amount of the unmodified polyester resin is less than 50% by mass, the formed toner may be poor in low-temperature fixing property and glossiness unevenness and solid image's surface roughness may occur.

The mixing ratio by mass of the crystalline polyester resin to the non-crystalline resin (i.e., crystalline polyester resin/non-crystalline resin) is not particularly limited, so long as the below-described peak ratio (W/R) falls within a predetermined rage, and may be appropriately selected depending on the intended purpose.

The molecular weight of the polyester contained in the binder resin is not particularly limited and may be appropriately selected depending on the intended purpose. In the molecular weight distribution of the THF soluble matter of the polyester, preferably, the peak of the weight average molecular weight is in the range of 1,000 to 30,000, the amount of the component having a weight average molecular weight of 30,000 or higher is 1% by mass to 80% by mass, and the number average molecular weight is 2,000 to 15,000.

In addition, in the molecular weight distribution of the THF soluble matter of the polyester contained in the binder resin, the component having a molecular weight of 1,000 or lower is preferably 0.1% by mass to 5.0% by mass. Also, the amount of the THF insoluble matter of the polyester contained in the binder resin is preferably 1% by mass to 15% by mass.

<<<Releasing Agent>>>

The releasing agent is not particularly limited and may be appropriately selected depending on the intended purpose. Examples thereof include paraffin waxes, microcrystalline waxes and petroleum waxes such as petrolatum. These may be used alone or in combination.

Among them, the releasing agent is preferably microcrystalline waxes, since the releasing agent exudes easily from the interior of the toner, exhibiting its releasing effects to improve glossiness unevenness and solid image's surface roughness.

The microcrystalline wax is not particularly limited and may be appropriately selected depending on the intended purpose. The microcrystalline wax is preferably C20-C80 hydrocarbons, more preferably C40-C60 hydrocarbons. When the number of the carbon atoms is smaller than 20, the penetration degree of the formed toner becomes large (i.e., the formed toner becomes soft) to cause aggregation of the toner. In addition, the toner easily causes filming on the photoconductor and fixing unit. Furthermore, the toner also stains the members disposed downstream of the fixing unit around the photoconductor (e.g., paper-feeding rollers in the apparatus), shortening the service life of each member. When the number of the carbon atoms is higher than 80, the releasing agent cannot be finely dispersed during fixing, resulting in that the releasing agent cannot exhibit its releasing effects on the surface of an image, not preventing staining. As a result, glossiness unevenness and solid image's surface roughness may occur.

Also, the average carbon number of the microcrystalline releasing agent is not particularly limited and may be appropriately selected depending on the intended purpose. It is preferably in the range of 50±20, more preferably in the range of 50±10. The average carbon number is preferably a smaller value within the above preferable range, since the releasing property at low temperatures becomes good. Also, the average carbon number is preferably a greater value within the above preferable range, since the aggregation resistance and filming resistance are improved.

The number of carbon atoms or the average number of carbon atoms contained in the releasing agent can be measured through, for example, high-temperature gel permeation chromatography (high-temperature GPC).

In the chromatogram of the releasing agent measured through high-temperature GPC, the number of carbon atoms contained in the releasing agent refers to a value obtained through dividing the molecular weight of the releasing agent when the elution initiates by the molecular weight of the methylene group; i.e., 14 and a value through dividing the molecular weight of the releasing agent when the elution terminates by the molecular weight of the methylene group; i.e., 14. That is, the number of carbon atoms contained therein shows the distribution of carbon atoms constituting the hydrocarbon.

Also, the average number of carbon atoms refers to a value through obtaining the peak molecular weight by the molecular weight of the methylene group; i.e., 14, in the chromatogram of the releasing agent measured through high-temperature GPC.

The above molecular weight can be measured as follows. Specifically, using as a solvent o-dichlorobenzene containing 0.1% by mass ionol, a sample is eluted at 135° C. and detected with a differential refractive index detector. And, the molecular weight of the eluate is obtained through conversion to the absolute molecular weight based on polyethylene by the universal calibration method.

The above releasing agent can be obtained in the below-described manner as a releasing agent containing hydrocarbon whose carbon atoms are desired. Specifically, the releasing agent is separated/purified from the residual oil after reduced-pressure distillation or heavy distillate of oil, followed by fractionating through high-temperature GPC.

The amount of the linear hydrocarbon contained in the releasing agent is not particularly limited and may be appropriately selected depending on the intended purpose. The amount of the linear hydrocarbon is preferably 55% by mass to 70% by mass, more preferably 60% by mass to 70% by mass, based on the total amount of the hydrocarbon contained in the releasing agent. When the linear hydrocarbon is lower than 55% by mass, the wax may be degraded in releasability. Whereas when it is more than 70% by mass, the formed toner may be degraded in storageability.

The amount of the linear hydrocarbon contained can be measured through, for example, gas chromatography. A mixture of a linear hydrocarbon and a non-linear hydrocarbon is separated when being moved over a stationary phase by carrier gas, since they are moved at different rates due to their different adsorption or distribution profiles onto the stationary phase. Thus, the amount of the linear hydrocarbon contained can be calculated from the retention time of peaks appearing in the gas chromatogram and the peak area ratio.

The separation column used in the gas chromatography is not particularly limited and may be appropriately selected depending on the intended purpose. Examples thereof include a packed column and a capillary column.

When the separation column used is a packed column, a filler used is not particularly limited and may be appropriately selected depending on the intended purpose. Examples of the filler include activated carbon, activated alumina, silica gel, porous spherical silica, molecular sieves, other adsorptive materials (e.g., inorganic salts); diatomaceous earth, refractory brick powder, glass, fused silica beads, and fine particles (e.g., graphite particles) each having on the surface a thin film of paraffin oil, silicone oil, etc.

When the separation column used is a capillary column, paraffin oil silicone oil, etc. may be applied before use without using any filler.

The carrier gas is not particularly limited and may be appropriately selected depending on the intended purpose. Examples thereof include nitrogen, helium, hydrogen and argon.

The detector used for the gas chromatography is not particularly limited and may be appropriately selected depending on the intended purpose. Examples thereof include a thermal conductivity meter of heat ray, a gas densitometer, an ionization cross section meter, and ionization detectors (e.g., hydrogen flame, β rays, electron trapping and radio-frequency waves).

The melting point of the releasing agent is not particularly limited and may be appropriately selected depending on the intended purpose. In the differential scanning calorimetry curve obtained through differential scanning calorimetry (DSC), the temperature at which the endothermic peak, where the amount of heat absorbed becomes maximum, is observed (hereinafter the temperature may be referred to as "maximum endothermic peak temperature") is preferably 65° C. to 90° C., more preferably 75° C. to 85° C. When the melting point is lower than 65° C., the penetration degree of the formed toner becomes large (i.e., the formed toner becomes soft) to cause aggregation of the toner. In addition, the toner easily causes filming on the photoconductor and fixing unit, and shortens the service life of the fixing unit. Whereas when the melting point exceeds 90° C., the releasing agent cannot be finely dispersed, resulting in that the releasing agent cannot exhibit its releasing effects on the surface of an image, not preventing staining. As a result, solid image's surface roughness may occur.

The amount of the releasing agent contained in the toner is not particularly limited and may be appropriately selected depending on the intended purpose. The amount thereof is preferably 1% by mass to 20% by mass, more preferably 1% by mass to 10% by mass, based on the total amount of the toner base particles. When the amount of the releasing agent is lower than 1% by mass, the releasing agent cannot be finely dispersed during fixing, resulting in that the releasing agent cannot exhibit its releasing effects on the surface of an image, not preventing staining. As a result, solid image's surface roughness may occur. When the amount of the releasing agent exceeds 20% by mass, the releasing agent exudes in too a large amount on the toner surface, potentially staining the members disposed downstream of the fixing unit around the photoconductor (e.g., paper-feeding rollers in the apparatus) to shorten the service life of each member.

<<<Colorant>>>

The toner containing the toner base particles may contain a colorant as an ingredient of the toner material.

The colorant is not particularly limited and may be appropriately selected from known dyes and pigments depending on the intended purpose. Examples thereof include carbon black, nigrosine dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red F5R, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS and BC), indigo, ultramarine, iron blue, anthraquinon blue, fast violet B, methylviolet lake, cobalt purple, manganese violet, dioxane violet, anthraquinon violet, chrome green, zinc green, chromium oxide, viridian, emerald green, pigment green B, naphthol green B, green gold, acid green lake, malachite green lake, phthalocyanine green, anthraquinon green, titanium oxide, zinc flower, lithopone and mixtures thereof. These may be used alone or in combination.

The amount of the colorant contained in the toner is not particularly limited and may be appropriately selected depending on the intended purpose. It is preferably 1% by mass to 15% by mass, more preferably 3% by mass to 10% by mass, with respect to the toner.

<<<Charge-Controlling Agent>>>

The toner containing the toner base particles may contain a charge controlling agent as an ingredient of the toner material.

The charge controlling agent is not particularly limited and may be appropriately selected from known charge controlling agents. Examples thereof include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine active agents, metal salts of salicylic acid, and metal salts of salicylic acid derivatives. These may be used alone or in combination.

Specific examples include nigrosine dye BONTRON 03, quaternary ammonium salt BONTRON P-51, metal-containing azo dye BONTRON S-34, oxynaphthoic acid-based metal complex E-82, salicylic acid-based metal complex E-84 and phenol condensate E-89 (these products are of ORIENT CHEMICAL INDUSTRIES CO., LTD), quaternary ammonium salt molybdenum complex TP-302 and TP-415 (these products are of Hodogaya Chemical K.K), quaternary ammonium salt COPY CHARGE PSY VP 2038, triphenylmethane derivative COPY BLUE PR, quaternary ammonium salt COPY CHARGE NEG VP2036 and COPY CHARGE NX VP434 (these products are of Hoechst AG), LRA-901 and boron complex LR-147 (these products are of Japan Carlit K.K.), copper phthalocyanine, perylene, quinacridone, azo pigments, and polymeric compounds having, as a functional group, a sulfonic acid group, carboxyl group, quaternary ammonium salt, etc.

The charge controlling agent contained is not flatly determined and is varied depending on the type of the binder resin used, on an optionally used additive, and on the toner production method used (including the dispersion method used). The amount of the charge controlling agent is preferably 0.1 parts by mass to 10 parts by mass, more preferably 0.2 parts by mass to 5 parts by mass, per 100 parts by mass of the binder resin. When the amount of the charge controlling agent is more than 10 parts by mass, the formed toner has too high chargeability, resulting in that the charge controlling agent exhibits reduced effects. As a result, the electrostatic force increases between the developing roller and the toner, decreasing the fluidity of the toner and forming an image with reduced color density.

The charge controlling agent may be melt-kneaded together with the below-described masterbatch or resin before dissolution or dispersion. Alternatively, it may be directly added at the time when other toner components are dissolved or dispersed in an organic solvent at the preparation step of a toner material liquid (oil phase). Furthermore, after the formation of the toner base particles, it may be fixed on the surfaces of the toner base particles.

<<<Fine Resin Particles>>>

Fine resin particles may be used for forming the toner base particles contained in the toner. The fine resin particles can improve dispersion stability and allow the toner containing the toner base particles to have a narrow particle size distribution.

The fine resin particles are not particularly limited and may be any resin, so long as they can form desired aqueous dispersoids when a toner material liquid (oil phase), which has been obtained by dissolving or dispersing in an organic solvent the toner material containing at least the binder resin and the releasing agent, is emulsified or dispersed in an aqueous medium (aqueous phase).

The fine resin particles may be a thermoplastic resin or a thermosetting resin. Examples thereof include vinyl resins, polyurethans, epoxy resins, polyesters, polyamides, polyimides, silicon-containing resins, phenol resins, melamine resins, urea resins, aniline resins, ionomer resins and polycarbonates. These may be used alone or in combination.

Among them, preferred are vinyl resins, polyurethans, epoxy resins, polyesters, polyamides and mixtures thereof, from the viewpoint of easily obtaining aqueous dispersoids of the fine spherical resin particles.

The vinyl resin is a polymer produced through homopolymerization or copolymerization of vinyl monomers. Examples of the vinyl resin include styrene-(meth)acylate resins, styrene-butadiene copolymers, (meth)acrylic acid-acrylate polymers, styrene-acrylonitrile copolymers, styrene-maleic anhydride copolymers and styrene-(meth)acrylic acid copolymers.

The volume average particle diameter of the fine resin particles is not particularly limited and may be appropriately selected depending on the intended purpose. It is preferably 5 nm to 500 nm.

<<<External Additive>>>

The toner contains the toner base particles formed of particles (colored particles) which are granulated through, for example, desolvation of an emulsion or dispersion liquid of the toner material liquid (oil phase) in the aqueous medium (aqueous phase). Here, in order to improve flowability, developability, chargeability and cleanability of the toner containing the toner base particles, an external additive may be attached onto the surfaces of toner base particles.

The external additive is not particularly limited and may be appropriately selected depending on the intended purpose. Examples thereof include fine inorganic particles, fine polymer particles, a fluidizing agent, a cleanability improver and magnetic materials. These may be used alone or in combination.

Among them, the toner preferably contains fine inorganic particles.

—Fine Inorganic Particles—

The fine inorganic particles are not particularly limited and may be appropriately selected depending on the intended purpose. Examples thereof include silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide and silicon nitride. These may be used alone or in combination.

The primary particle diameter of the fine inorganic particles is not particularly limited and may be appropriately selected depending on the intended purpose. It is preferably 5 nm to 2 μm, particularly preferably 5 nm to 500 nm.

Also, the specific surface area of the toner measured by the BET method is not particularly limited and may be appropriately selected depending on the intended purpose. It is preferably 20 $m^2/g$ to 500 $m^2/g$.

The amount of the fine inorganic particles used is not particularly limited and may be appropriately selected depending on the intended purpose. It is preferably 0.01% by mass to 5% by mass, particularly preferably 0.01% by mass to 2.0% by mass, with respect to the toner.

—Fine Polymer Particles—

In addition to the fine inorganic particles, fine polymer particles may be used as the external additive.

The fine polymer particles are not particularly limited and may be appropriately selected depending on the intended purpose. Examples thereof include polystyrenes obtained through, for example, soap-free emulsion polymerization, suspension polymerization or dispersion polymerization; methacrylate copolymers and acrylate copolymers; polycondensates such as silicone, benzoguanamine and Nylon; and polymer particles of thermosetting resins. These may be used alone or in combination.

The fine polymer particles have a relatively narrow particle size distribution. The volume average particle diameter of the fine polymer particles is not particularly limited and may be appropriately selected depending on the intended purpose. It is preferably 0.01 μm to 1 μm.

—Fluidizing Agent—

When the toner contains the fluidizing agent, the flowability and charging property can be prevented from being degraded even under high-humidity conditions by increasing hydrophobicity through surface treatments.

The fluidizing agent is not particularly limited and may be appropriately selected depending on the intended purpose. Examples thereof include silane coupling agents, silylating agents, fluorinated alkyl group-containing silane coupling agents, organic titanate-containing coupling agents, aluminum-containing coupling agents, silicone oil and modified silicone oil. These may be used alone or in combination.

—Cleanability Improver—

The cleanability improver is used for the remaining developer (toner) to be removed from the photoconductor and primary transfer medium after transfer. Examples thereof include metal salts of fatty acids (e.g., stearic acid) such as zinc stearate and calcium stearate; and fine polymer particles produced through soap-free emulsion polymerization such as fine polymethyl methacrylate particles and fine polystyrene particles. These may be used alone or in combination.

<<<Average Particle Diameter>>>

The toner preferably has the following properties such as volume average particle diameter (Dv) and volume average particle diameter (Dv)/number average particle diameter (Dn) described below.

The volume average particle diameter (Dv) of the toner is preferably 3 μm to 8 μm, more preferably 4 μm to 7 μm, still more preferably 5 μm to 6 μm.

When used in a two-component developer, the toner having a volume average particle diameter smaller than 3 μm is fused on the surface of a carrier after long-term stirring in a developing device, potentially reducing the chargeability of the carrier. When used in a one-component developer, filming of the toner to a developing unit (e.g., a developing roller) is caused. In addition, the toner tends to fuse on, for example, a member such as a blade for reducing the thickness of the toner. Whereas, a toner having a volume average particle diameter larger than 8 μm cannot provide a high-resolution, high-quality image in some cases, and may exhibit large variation in its particle diameter after repetitive cycles of consumption and addition thereof in the developer.

The ratio of volume average particle diameter (Dv) to number average particle diameter (Dn) of the toner (Dv/Dn) is preferably 1.25 or lower, more preferably 1 to 1.2, more preferably 1.1 to 1.2.

When the ratio (Dv/Dn) of volume average particle diameter to number average particle diameter is 1.25 or lower, the toner has a relatively sharp particle size distribution to be improved in fixing property. When used in a two-component developer, the toner having a ratio (Dv/Dn) lower than 1 is fused on the surface of a carrier after long-term stirring in a developing unit, potentially reducing the chargeability of the carrier and degrading cleanability of the toner. When used in a one-component developer, filming of the toner to a development unit (e.g., a developing roller) is caused. In addition, the toner tends to fuse on, for example, a member such as a blade for reducing the thickness of the toner. Whereas, a toner having a ratio (Dv/Dn) larger than 1.25 cannot provide a high-resolution, high-quality image in some cases, and may exhibit large variation in its particle diameter after repetitive cycles of consumption and addition thereof in the developer.

Here, the volume average particle diameter and the ratio (Dv/Dn) of volume average particle diameter to number average particle diameter can be measured using, for example, a particle size analyzer (Multisizer II, product of Beckman Coulter Co.).

The color of the toner is not particularly limited and may be appropriately selected depending on the intended purpose. The toner is at least one selected from black toner, cyan toner, magenta toner and yellow toner. The color of the toner can be determined by appropriately selecting a colorant from the colorants listed above. The toner is preferably a color toner.

<<<Peak Ratio (W/R)>>>

The amount of the crystalline polyester resin or the non-crystalline resin localized in the surface of the toner can be measured based on an absorbance spectrum obtained by a total transmission method (KBr method) using FT-IR (a Fourier transform infrared spectrometer, for example, Avatar370/product of ThermoElectron Corporation). Here, the peak ratio W/R of the peak of the crystalline polyester resin to the peak of the non-crystalline resin is 0.045 to 0.85, preferably 0.08 to 0.45, where W denotes a peak height in a spectrum of the crystalline polyester resin and R denotes a peak height in a spectrum of the non-crystalline resin. When the peak ratio (W/R) is less than 0.045, the releasing agent cannot be finely dispersed during fixing, resulting in that the releasing agent cannot exhibit its releasing effects on the surface of an image, not preventing staining. As a result, glossiness unevenness and solid image's surface roughness may occur. When the peak ratio (W/R) is more than 0.85, the releasing agent exudes in too a large amount on the toner surface, potentially staining the members disposed downstream of the fixing unit around the photoconductor (e.g., paper-feeding rollers in the apparatus) to shorten the service life of each member.

Here, the definition of W or R will be described in detail with reference to the corresponding drawings.

Figure 5:
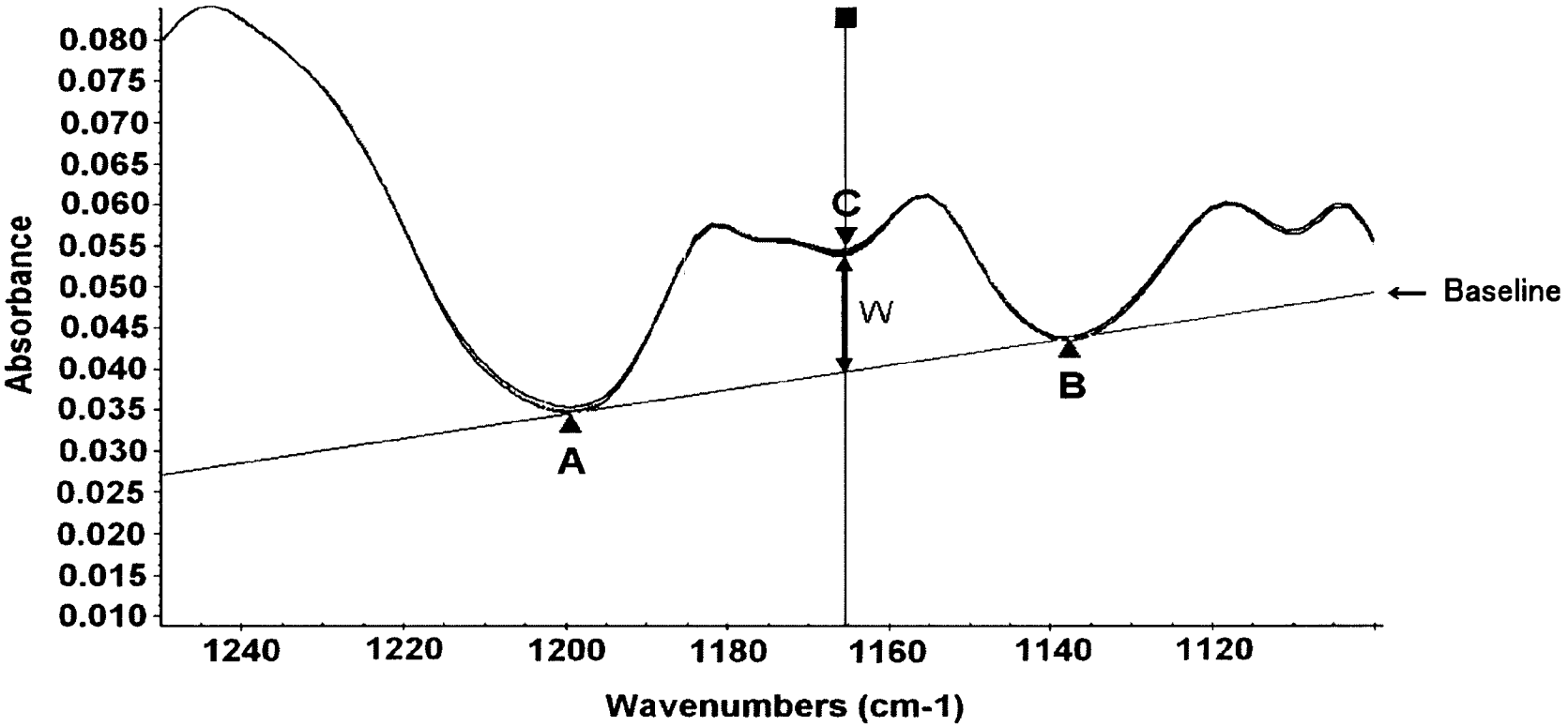
FIG. 5 is one exemplary FT-IR spectrum when a crystalline polyester resin is in a crystalline state, where the vertical axis: Absorbance and the horizontal axis: Wavenumbers ($cm^{-1}$)).

FIG. 5 is one exemplary FT-IR spectrum when the crystalline polyester resin is in a crystalline state. In this spectrum, a tangential line is drawn so as to pass peak bottom A between 1,210 $cm^{-1}$ to 1,190 $cm^{-1}$ and peak bottom B between 1,150

$cm^{-1}$ to 1,130 $cm^{-1}$ in the X axis of wavenumbers, and is used as a baseline. In addition, a perpendicular line to the X axis is drawn from peak bottom C between 1,175 $cm^{-1}$ to 1,155 $cm^{-1}$ in the X axis of wavenumbers. Here, W is defined as a peak height obtained by subtracting the absorbance at the intersection point between the perpendicular line and the baseline from the absorbance of the peak bottom C (peak height).

Figure 6:
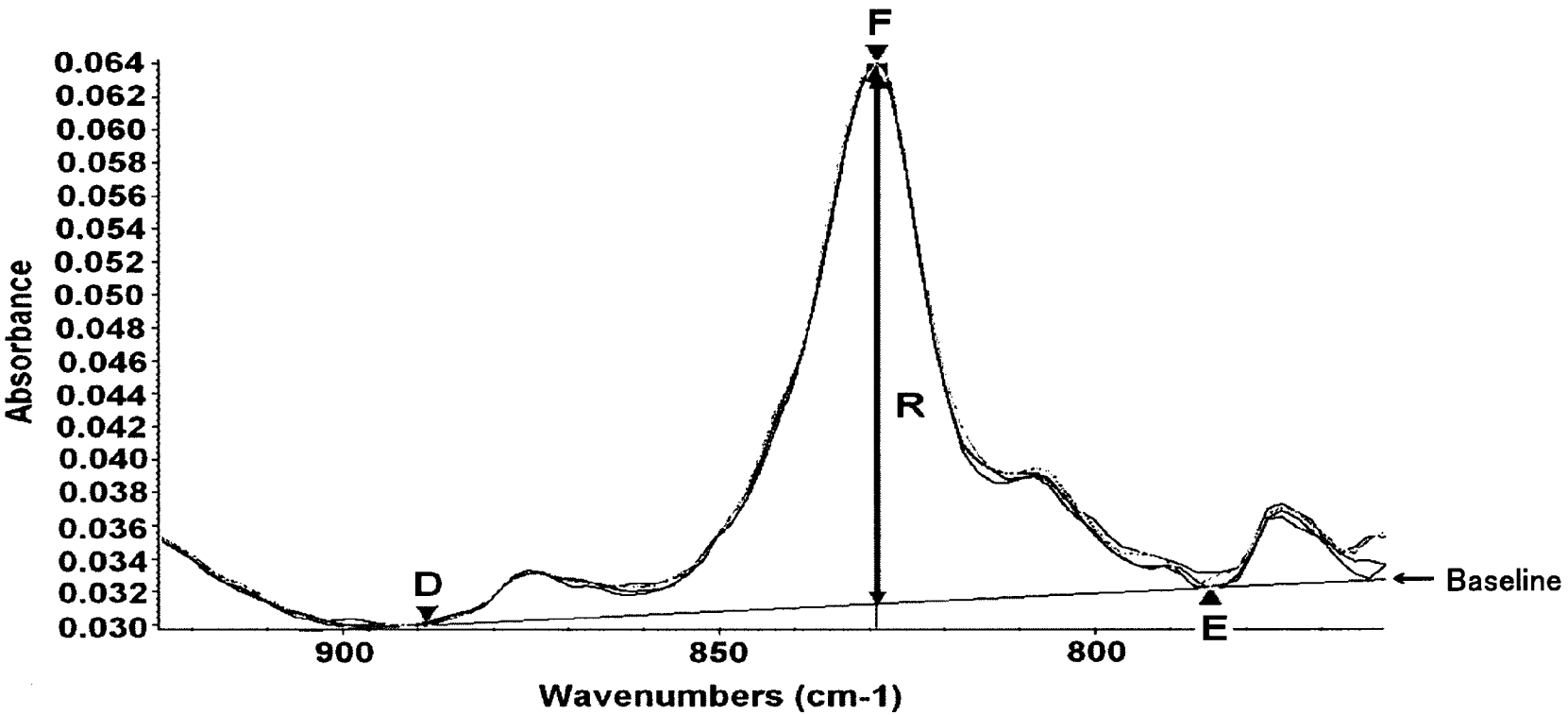
FIG. 6 is one exemplary FT-IR spectrum of a non-crystalline resin, where the vertical axis: Absorbance and the horizontal axis: Wavenumbers ($cm^{-1}$)).

FIG. 6 is one exemplary FT-IR spectrum of the non-crystalline resin. In this spectrum, a tangential line is drawn so as to pass peak bottom D between 900 $cm^{-1}$ to 880 $cm^{-1}$ and peak bottom E between 775 $cm^{-1}$ to 795 $cm^{-1}$ in the X axis of wavenumbers, and is used as a baseline. In addition, a perpendicular line to the X axis is drawn from peak top F between 850 $cm^{-1}$ to 820 $cm^{-1}$ in the X axis of wavenumbers. Here, R is defined as a peak height obtained by subtracting the absorbance at the intersection point between the perpendicular line and the baseline from the absorbance of the peak top F (peak height).

The peak intensity ratio indicated by W/R between the crystalline polyester resin and the non-crystalline resin can be calculated from W and R as defined above.

Notably, the peak intensity ratio in the present invention uses the peak height of the absorbance into which the spectrum has been converted.

The method for adjusting the peak ratio (W/R) is not particularly limited and may be appropriately selected depending on, for example, the crystalline state of the crystalline polyester resin. Examples thereof include a method by adjusting the amounts of the crystalline polyester resin and the non-crystalline resin in the toner production step, and a method by adjusting the ratio between the amounts of the crystalline polyester resin and the non-crystalline resin.

Although how the releasing agent easily exudes by the crystalline polyester resin is not clear, the following mechanism is presumed.

That is, the crystalline polyester resin and the releasing agent are not compatible to the non-crystalline resin (amorphous resin) in the toner base particles and, for example, they are dispersed in a crystalline state. Since the crystalline polyester resin has affinity to the releasing agent, the crystalline polyester resin is easily accessible to the releasing agent. The crystalline polyester resin and the releasing agent aid their mutual dispersiblities, whereby they are easily finely dispersed in the toner base particles. As a result, the releasing agent uniformly dispersed easily exudes on the toner surface by energy of heat or pressure applied during fixing, to thereby exhibit its releasing effects to improve solid image's surface roughness.

In general, the crystallinity is measured through X-ray diffraction. However, the crystallinity in the toner is difficult to measure, since the amount of the crystalline polyester resin is small and the crystallinity is low. However, its has been found in the present invention to control the compatible state of the crystalline polyester resin and the non-crystalline resin by striking a balance between the problems on quality control through optimization of production conditions with a quality engineering technique (e.g., the proportion of toner raw materials and emulsification).

<<<Method for Producing Toner>>>

The method for producing the toner is not particularly limited and may be appropriately selected depending on the intended purpose. Examples thereof include melt-kneading pulverization methods and polymerization methods. The polymerization methods are more advantageous since they achieve higher dispersibility and homogeneity of the toner material as compared with the melt-kneading pulverization methods.

The polymerization method for producing the polymerization toner is not particularly limited and may be appropriately selected depending on the intended purpose. Examples thereof include chemical production methods such as suspension polymerization methods, emulsification aggregation polymerization methods, ester elongation polymerization methods and dissolution suspension methods. Among them, ester elongation polymerization methods are preferred, since they can achieve high dispersion homogeneity of the non-crystalline resin and the releasing agent in the toner. In addition, the toner obtained by the ester elongation polymerization methods allows the releasing agent to appropriately exude on the toner surfaces during fixing, to thereby further improve glossiness unevenness and solid image's surface roughness.

The ester elongation polymerization method preferably includes at least an emulsion dispersion step and a desolvation step. If necessary, it may further include other steps such as a washing step, a drying step and a classification step. With this method, a dry toner can be produced.

—Emulsion Dispersion Step—

The emulsion dispersion step is a step of preparing a toner material liquid (oil phase) by dissolving or dispersing, in an organic solvent, toner materials including at least a binder resin and a releasing agent; and by emulsifying or dispersing the oil phase in an aqueous medium (aqueous phase) to obtain emulsified dispersoids.

The organic solvent used for the preparation of the toner material liquid (oil phase) is not particularly limited, so long as it can dissolve or disperse the toner materials, and may be appropriately selected depending on the intended purpose. The organic solvent is preferably a volatile organic solvent having a boiling point lower than 150° C. from the viewpoint of easily removing the organic solvent. Examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone. These may be used alone or in combination.

Among them, preferred are toluene, xylene, benzene, methylene chloride, 1,2-dichloroethane, chloroform and carbon tetrachloride. Ethyl acetate is particularly preferred.

The emulsified dispersion liquid can be prepared by dispersing the toner solution in an aqueous medium. By dispersing the toner solution in the aqueous medium, dispersoids (oil droplets) of the toner solution are formed in the aqueous medium.

The aqueous medium (aqueous phase) is not particularly limited and may be appropriately selected depending on the intended purpose. It may be water alone or a combination of water and a water-miscible solvent. The water-miscible solvent is not particularly limited and may be appropriately selected depending on the intended purpose. Examples thereof include alcohols (e.g., methanol, isopropanol and ethylene glycol), dimethylformamide, tetrahydrofuran, cellosolves (e.g., methyl cellosolve) and lower ketones (e.g., acetone and methyl ethyl ketone). These may be used alone or in combination.

Also, the aqueous medium (aqueous phase) may contain a dispersing agent such as a surfactant or polymeric protective colloid described below.

When the isocyanate group-containing polyester (polyester prepolymer (A)) and the amine (B) are used as a binder resin precursor for forming the toner base particles, the polyester prepolymer (A) and the amine (B) may be reacted together in the aqueous medium to form a modified polyester resin (e.g., a urea-modified polyester resin). Alternatively, the polyester prepolymer (A) and the amine (B) may be reacted together in advance to form a modified polyester resin (e.g., a urea-modified polyester resin) which is to be used.

The method for stably forming, in the aqueous medium, dispersoids formed of the urea-modified polyester resin or polyester prepolymer (A) and the amine (B) is not particularly limited and may be appropriately selected depending on the intended purpose. Examples thereof include a method in which a composition of toner materials (raw materials) including the modified polyester resin or the prepolymer (A), the amine (B), other binder resins (e.g., a crystalline polyester resin) and a releasing agent is added to the aqueous medium, followed by dispersing through application of shearing force.

The polyester prepolymer (A) may be mixed with other toner components (hereinafter referred to as "toner raw materials") such as a colorant (or a colorant masterbatch), a releasing agent, a crystalline polyester resin, an unmodified polyester resin and a charge controlling agent when forming dispersoids in an aqueous medium. Preferably, toner raw materials are previously mixed together and then the resultant mixture is dispersed in an aqueous medium.

Also, in the present invention, toner raw materials such as colorant and a charge controlling agent are not necessarily added to an aqueous medium before particle formation. These toner raw materials may be added thereto after particle formation. For example, after particles containing no colorant are formed, a colorant may be added to the obtained particles with a known dying method.

The dispersion method is not particularly limited and may be appropriately selected from known dispersion methods depending on the intended purpose. Examples thereof include dispersion methods using a low-speed shearing disperser, a high-speed shearing disperser, a friction disperser, a high-pressure jetting disperser or an ultrasonic disperser. The method using a high-speed shearing disperser is preferably employed since the dispersoids can be dispersed so as to have a particle diameter of 2 μm to 20 μm.

In use of the high-speed shearing disperser, the rotating speed is not particularly limited and may be appropriately selected depending on the intended purpose. It is generally 1,000 rpm to 30,000 rpm, preferably 5,000 rpm to 20,000 rpm.

The dispersion time is not particularly limited and may be appropriately selected depending on the intended purpose. It is generally 0.1 min to 5 min when a batch method is employed.

The temperature during dispersion is not particularly limited and may be appropriately selected depending on the intended purpose. It is generally 0° C. to 150° C. (in a pressurized state), preferably from 40° C. to 98° C. The temperature is preferably higher, since the dispersoids formed of the modified polyester resin (urea-modified polyester resin) and the polyester prepolymer (A) has a lower viscosity and thus can be readily dispersed.

The amount of the aqueous medium used per 100 parts by mass of the toner materials (toner composition) including the modified polyester resin, the polyester prepolymer (A) and the amine (B) is not particularly limited and may be appropriately selected depending on the intended purpose. It is preferably 50 parts by mass to 2,000 parts by mass, more preferably 100 parts by mass to 1,000 parts by mass. When the amount the aqueous medium used is less than 50 parts by mass, the toner composition cannot be sufficiently dispersed, resulting in failure to form toner particles having a predetermined particle diameter. Meanwhile, use of the aqueous medium more than 2,000 parts by mass is economically disadvantageous.

If necessary, a dispersant may be used as described above. Use of the dispersant is preferred from the viewpoints of attaining a sharp particle size distribution and realizing a stable dispersion state.

As described above, in the step of synthesizing the urea-modified polyester resin from the polyester prepolymer (A) and the amine (B), the amine (B) may be previously added to the aqueous medium, and then the toner material liquid containing the polyester prepolymer (A) (oil phase) may be dispersed for reaction in the aqueous medium. Alternatively, the toner material liquid containing the polyester prepolymer (A) (oil phase) may be added to the aqueous medium and then the amine (B) may be added to the aqueous medium so that reaction occurs from the interfaces between particles. In this case, the urea-modified polyester resin is formed preferentially in the surfaces of the formed toner base particles. As a result, the concentration gradient can be formed in each particle.

A surfactant may be used as a dispersing agent for emulsifying or dispersing, in an aqueous liquid (aqueous phase), a toner materials liquid containing the toner material dispersed therein (oil phase).

The surfactant is not particularly limited and may be appropriately selected depending on the intended purpose. Examples thereof include anionic surfactants such as alkylbenzenesulfonic acid salts, α-olefin sulfonic acid salts and phosphoric acid esters; cationic surfactants such as amine salts (e.g., alkyl amine salts, aminoalcohol fatty acid derivatives, polyamine fatty acid derivatives and imidazoline), and quaternary ammonium salts (e.g., alkyltrimethylammonium salts, dialkyl dimethylammonium salts, alkyl dimethyl benzyl ammonium salts, pyridinium salts, alkyl isoquinolinium salts and benzethonium chloride); nonionic surfactants such as fatty acid amide derivatives and polyhydric alcohol derivatives; and amphoteric surfactants such as alanine, dodecyl-di (aminoethyl)-glycine, di(octylaminoethyl)-glycine and N-alkyl-N,N-dimethylammonium betaine. These may be used alone or in combination.

Among the above surfactans, a fluoroalkyl group-containing surfactant is preferably used, since it can provide, even in a considerably small amount, a dispersion liquid having a desired dispersion state.

The fluoroalkyl group-containing surfactant is not particularly limited and may be appropriately selected depending on the intended purpose. Examples thereof include fluoroalkyl carboxylic acids having 2 to 10 carbon atoms and metal salts thereof, disodium perfluorooctanesulfonylglutamate, sodium 3-[omega-fluoroalkyl(C6 to C11)oxy)-1-alkyl(C3 or C4) sulfonates, sodium 3-[omega-fluoroalkanoyl(C6 to C8)-N-ethylamino]-1-propanesulfonates, fluoroalkyl(C11 to C20) carboxylic acids and metal salts thereof, perfluoroalkylcarboxylic acids(C7 to C13) and metal salts thereof, perfluoroalkyl(C4 to C12)sulfonate and metal salts thereof, perfluorooctanesulfonic acid diethanol amide, N-propyl-N-(2-hydroxyethyl)perfluorooctanesulfone amide, perfluoroalkyl(C6 to C10)sulfoneamidepropyltrimethylammonium salts, salts of perfluoroalkyl(C6 to C10)-N-ethylsulfonylglycin and monoperfluoroalkyl(C6 to C16) ethylphosphates.

Specific examples of the fluoroalkyl group-containing surfactant include SURFLON S-111, S-112 and S-113 (these products are of Asahi Glass Co., Ltd.); FRORARD FC-93, FC-95, FC-98 and FC-129 (these products are of Sumitomo 3M Ltd.); UNIDYNE DS-101 and DS-102 (these products are of Daikin Industries, Ltd.); MEGAFACE F-110, F-120, F-113, F-191, F-812 and F-833 (these products are of DIC, Inc.); EFTOP EF-102, 103, 104, 105, 112, 123A, 123B, 306A, 501, 201 and 204 (these products are of Tohchem Products Co., Ltd.); and FUTARGENT F-100 and F150 (these products are of NEOS COMPANY LIMITED).

Also, the cationic surfactant is not particularly limited and may be appropriately selected depending on the intended purpose. Examples thereof include fluoroalkyl group-containing primary, secondary or tertiary aliphatic compounds, aliphatic quaternary ammonium salts (e.g., perfluoroalkyl(C6 to C10)sulfoneamide propyltrimethylammonium salts), benzalkonium salts, benzetonium chloride, pyridinium salts and imidazolinium salts. Examples of commercially available products of the above-listed cationic surfactants include SURFLON S-121 (product of Asahi Glass Co., Ltd.); FRORARD FC-135 (product of Sumitomo 3M Ltd.); UNIDYNE DS-202 (product of Daikin Industries, Ltd.); MEGAFACE F-150 and F-824 (these products are of DIC, Inc.); EFTOP EF-132 (product of Tohchem Products Co., Ltd.); and FUTARGENT F-300 (product of Neos COMPANY LIMITED).

In addition, poorly water-soluble inorganic dispersing agents may be used. The poorly water-soluble inorganic dispersing agents are not particularly limited and may be appropriately selected depending on the intended purpose. Examples thereof include tricalcium phosphate, calcium carbonate, titanium oxide, colloidal silica and hydroxyapatite.

Further, a polymeric protective colloid may be used to stabilize liquid droplets. Examples thereof include homopolymers and copolymers prepared using acids (e.g., acrylic acid, methacrylic acid, α-cyanoacrylic acid, α-cyanomethacrylic acid, itaconic acid, crotonic acid, fumaric acid, maleic acid and maleic anhydride), hydroxyl group-containing (meth)acrylic monomers (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid esters, diethylene glycol monomethacrylic acid esters, glycerin monoacrylic acid esters, glycerin monomethacrylic acid esters, N-methylolacrylamide and N-methylolmethacrylamide), vinyl alcohol and ethers thereof (e.g., vinyl methyl ether, vinyl ethyl ether and vinyl propyl ether), esters formed between vinyl alcohol and a carboxyl group-containing compound (e.g., vinyl acetate, vinyl propionate and vinyl butyrate), acrylamide, methacrylamide, diacetoneacrylamide and methylol compounds of them; acid chlorides (e.g., acrylic acid chloride and methacrylic acid chloride) and nitrogen-containing compounds and nitrogen-containing heterocyclic compounds (e.g., vinyl pyridine, vinyl pyrrolidone, vinyl imidazole and ethyleneimine); polyoxyethylenes (e.g., polyoxyethylenes, polyoxypropylenes, polyoxyethylene alkyl amines, polyoxypropylene alkyl amines, polyoxyethylene alkyl amides, polyoxypropylene alkyl amides, polyoxyethylene nonylphenyl ethers, polyoxyethylene laurylphenyl ethers, polyoxyethylene stearylphenyl esters and polyoxyethylene nonylphenyl esters); and celluloses (e.g., methyl cellulose, hydroxyethyl cellulose and hydroxypropyl cellulose).

When an acid- or alkali-soluble compound (e.g., calcium phosphate) is used as a dispersion stabilizer, the calcium phosphate used is dissolved with an acid (e.g., hydrochloric acid), followed by washing with water, to thereby remove it from the formed fine particles. Also, the calcium phosphate may be removed through enzymatic decomposition.

Alternatively, the dispersing agent used may remain on the surfaces of the toner particles. But, the dispersing agent is preferably removed through washing after elongation and/or crosslinking reaction in terms of chargeability of the formed toner.

In order to increase the viscosity of the toner material liquid (oil phase) containing the toner material dissolved or dispersed therein, a solvent capable of dissolving the modified polyester resin and the polyester prepolymer (A) may be additionally used. Use of such a solvent is preferred since a sharp particle size distribution can be obtained. The solvent used is preferably a volatile solvent having a boiling point lower than 100° C. from the viewpoint of easily removing the solvent.

Such solvents are not particularly limited and may be appropriately selected depending on the intended purpose. Examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone. These may be used alone or in combination. Among them, the solvent is preferably an aromatic solvent such as toluene or xylene; or a halogenated hydrocarbon such as methylene chloride, 1,2-dichloroethane, chloroform or carbon tetrachloride.

The amount of the solvent used per 100 parts by mass of the polyester prepolymer (A) is not particularly limited and may be appropriately selected depending on the intended purpose. It is preferably 0 parts by mass to 300 parts by mass, more preferably 0 parts by mass to 100 parts by mass, still more preferably 25 parts by mass to 70 parts by mass.

When the solvent is used, the solvent is preferably removed with heating under normal or reduced pressure after completion of elongation and/or crosslinking reaction.

The time of the elongation and/or crosslinking reaction is not particularly limited. It may be appropriately selected depending on, for example, reactivity between the isocyanate group-containing moiety of the polyester prepolymer (A) and the amine (B), and is preferably 10 min to 40 hours, more preferably 2 hours to 24 hours.

The temperature of the elongation and/or crosslinking reaction is not particularly limited. It may be appropriately selected depending on, for example, reactivity between the isocyanate group-containing moiety of the polyester prepolymer (A) and the amine (B), and is preferably 0° C. to 150° C., more preferably 40° C. to 98° C.

If necessary, a known catalyst may be used in the elongation and/or crosslinking reaction. The catalyst is not particularly limited and may be appropriately selected depending on the intended purpose. Examples thereof include dibutyltinlaurate and dioctyltinlaurate. These may be used alone or in combination.

—Desolvation Step—

The desolvation step is a step of removing the organic solvent from the toner-containing emulsified dispersion liquid obtained at the emulsified dispersion step.

The method for removing the organic solvent from the emulsified dispersion liquid is not particularly limited and may be appropriately selected depending on the intended purpose. Examples thereof include a method in which the entire system is gradually increased in temperature to completely evaporate off the organic solvent contained in the liquid droplets; and a method in which the emulsified dispersion liquid is sprayed toward a dry atmosphere, to thereby completely evaporate off the water-insoluble organic solvent contained in the liquid droplets to form fine particles of toner base particles as well as evaporate off the aqueous dispersing agent.

The dry atmosphere toward which the emulsified dispersion liquid is sprayed is not particularly limited and may be appropriately selected depending on the intended purpose. It generally uses heated gas (e.g., air, nitrogen, carbon dioxide and combustion gas), especially, gas flow heated to a temperature equal to or higher than the highest boiling point of the solvents used. Treatments performed even in a short time using, for example, a spray dryer, a belt dryer or a rotary kiln allow the resultant product to have satisfactory quality.

—Washing Step—

The washing step is a step of washing the toner base particles obtained at the desolvation step.

The washing method is not particularly limited and may be appropriately selected depending on the intended purpose. Examples thereof include a method in which one or more selected from water, aqueous basic solution and aqueous acid solution are added to the toner base particles obtained at the desolvation step, followed by mixing and filtrating. The number of filtration treatments is not particularly limited and may be appropriately selected depending on the intended purpose. It is preferably larger.

—Drying Step—

The drying step is a step of drying the toner base particles after washing.

The drying method is not particularly limited and may be appropriately selected depending on the intended purpose. Examples thereof include air-circulating dry methods, spray dry methods, reduced pressure dry methods and freeze dry methods.

The drying temperature is not particularly limited and may be appropriately selected depending on the intended purpose. It is preferably 35° C. to 45° C., more preferably 35° C. to 40° C.

When the dispersoids having a broad particle size distribution are obtained at the emulsion dispersion step and are then subjected to washing and drying treatments while the particle size distribution is being maintained, the dispersoids may be classified so as to have a desired particle size distribution.

—Classification Step—

When the dispersoids having a broad particle size distribution are obtained at the emulsion dispersion step and are then subjected to washing and drying while the particle size distribution is being maintained, the dispersoids is preferably classified so as to have a desired particle size distribution. The classification may be performed after the washing step or the drying step.

The classification method is not particularly limited and may be appropriately selected depending on the intended purpose. Examples thereof include a method in which fine particles of unnecessary size are removed with a cyclone, a decanter or a centrifuge. The classification may be performed in the form of powder after drying, but is preferably performed in liquid in terms of efficiency.

The classified fine or coarse particles of unnecessary size may be returned to the emulsion dispersion step where they may be used for particle formation. Here, the fine or coarse particles may be in a wet or dry state.

The dispersing agent used is preferably removed from the obtained dispersing agent to the greatest extent possible. The removal of the dispersing agent is preferably performed simultaneously with the classification step.

The obtained powder after drying (toner base particles) is optionally mixed with foreign particles such as fine particles of the releasing agent, charge-controllable fine particles, fine particles of the fluidizing agent and colorant fine particles, followed by application of mechanical impact for fixing and fusing them, to thereby obtain a toner formed of base particles (toner containing base particles). The application of mechanical impact can prevent the foreign particles from being exfoliated from the surfaces of the obtained toner particles containing base particles (complex particles).

Examples of the specific method for applying mechanical impact include a method in which an impact is applied to a mixture using a high-speed rotating blade and a method in which a mixture is caused to pass through a high-speed airflow for acceleration and aggregated particles or complex particles are crushed against an appropriate collision plate.

Examples of apparatuses used in these methods include Ongmill (product of Hosokawa Micron Corp.), an apparatus produced by modifying an I-type mill (product of Nippon Neumatic Co., Ltd.) so that the pulverizing air pressure thereof is decreased, Hybridization System (product of Nara Machinery Co., Ltd.), Cryptron System (production of Kawasaki Heavy Industries, Ltd.) and an automatic mortar.

The toner may be a one-component developer (magnetic toner or non-magnetic toner) or a two-component developer.

When used for the two-component developer, the toner containing the toner base particles may be mixed with a magnetic carrier. The ratio of the amount of the magnetic carrier to the amount of the toner in the developer is not particularly limited and may be appropriately selected depending on the intended purpose. The amount of the toner is preferably 1 part by mass to 10 parts by mass per 100 parts by mass of the carrier.

The magnetic carrier is not particularly limited and may be appropriately selected depending on the intended purpose. Examples thereof include conventionally known carriers such as iron powder, ferrite powder, magnetite powder and magnetic resin carriers.

The particle size of the magnetic carrier is not particularly limited and may be appropriately selected depending on the intended purpose. It is preferably 20 μm to 200 μm.

The coating material of the magnetic carrier is not particularly limited and may be appropriately selected depending on the intended purpose. Examples thereof include amino-based resins such as urea-formaldehyde resins, melamine resins, benzoguanamine resins, urea resins, polyamide resins and epoxy resins; polyvinyl- or polyvinylidene-based resins such as acryl resins, poly methyl methacrylate resins, polyacrylonitrile resins, polyvinyl acetate resins, polyvinyl alcohol resins and polyvinyl butyral resins; polystyrene-based resins such as polystyrene resins and styrene-acryl copolymer resins; halogenated olefin resins such as polyvinyl chloride; polyester-based resins such as polyethylene terephthalate resins and polybutyrene terephthalate resins; polycarbonate-based resins, polyethylene resins, polyvinyl fluoride resins, polyvinylidene fluoride resins, polytrifluoroethylene resins, polyhexafluoropropylene resins, copolymers of vinylidene fluoride and an acryl monomer, copolymers of vinylidene fluoride and vinyl fluoride, fluoroterpolymers of tetrafluoroethylene, vinylidene fluoride and a non-fluorinated monomer; and silicone resins. These may be used alone or in combination.

If necessary, conductive powder, etc. may be incorporated into the coating resin. The conductive powder is not particularly limited and may be appropriately selected depending on the intended purpose. Examples thereof include metal powder, carbon black, titanium oxide, tin oxide and zinc oxide. These may be used alone or in combination.

The average particle diameter of the conductive powder is not particularly limited and may be appropriately selected depending on the intended purpose. It is preferably 1 μm or lower. When the average particle diameter exceeds 1 μm, it is difficult to control electrical resistance.

Also, the toner of the present invention may be used as a one-component developer using no carrier.

<Transfer Step and Transfer Unit>

The transfer step is a step of transferring the visible image onto the recording medium. In a preferred embodiment, visible images are primarily transferred onto an intermediate transfer medium, from which the visible image is secondarily transferred onto the recording medium.

The transfer can be performed by, for example, charging the photoconductor using a transfer charger, and can be performed by the transfer unit. The transfer unit preferably has a primary transfer unit configured to transfer visible images onto an intermediate transfer medium to form a composite transfer image, and a secondary transfer unit configured to transfer the composite transfer image onto a recording medium.

Here, when the image to be transferred onto the recording medium is a color image of several color toners, in one employable configuration, the transfer unit superposes the color toner images on top of another on the intermediate transfer medium to form an image on the intermediate transfer medium, and the image on the intermediate transfer medium is secondarily transferred at one time onto the recording medium by an intermediate transfer unit.

Notably, the intermediate transfer medium is not particularly limited and may be appropriately selected from known transfer media depending on the intended purpose. Preferred examples thereof include a transfer belt.

The transfer unit (the primary transfer unit and the secondary transfer unit) preferably has at least a transfer device which transfers the visible images formed on the photoconductor onto the recording medium through charging. The number of the transfer units may be one or more. Examples of the transfer device include a corona transfer device using corona discharge, a transfer belt, a transfer roller, a press transfer roller and an adhesion transfer device.

Notably, the recording medium is typically plane paper, but it is not particularly limited and may be appropriately selected depending on the intended purpose, so long as it can receive an unfixed image after developing. PET bases for OHP can also be used as the recording medium.

<Fixing Step and Fixing Unit>

The fixing step is a step of fixing the transferred visible image on the recording medium using a fixing unit. In this step, fixing may be performed ever time when an image of each color toner is transferred onto the recording medium, or at one time (at the same time) on a laminated image of color toners.

The fixing unit includes at least a rotatable heating member which heats the recording medium having the unfixed visible image, a rotatable pressing member which comes into contact with the rotatable heating member to form a nip portion, and an air separation member which separates the recording medium from the rotatable heating member by air; and, if necessary, further includes other members such as a fixing belt.

Here, one example of the fixing unit in the image forming apparatus of the present invention will be described with reference to the corresponding drawing. However, the image forming apparatus of the present invention should not be construed as being limited thereto.

Figure 2:
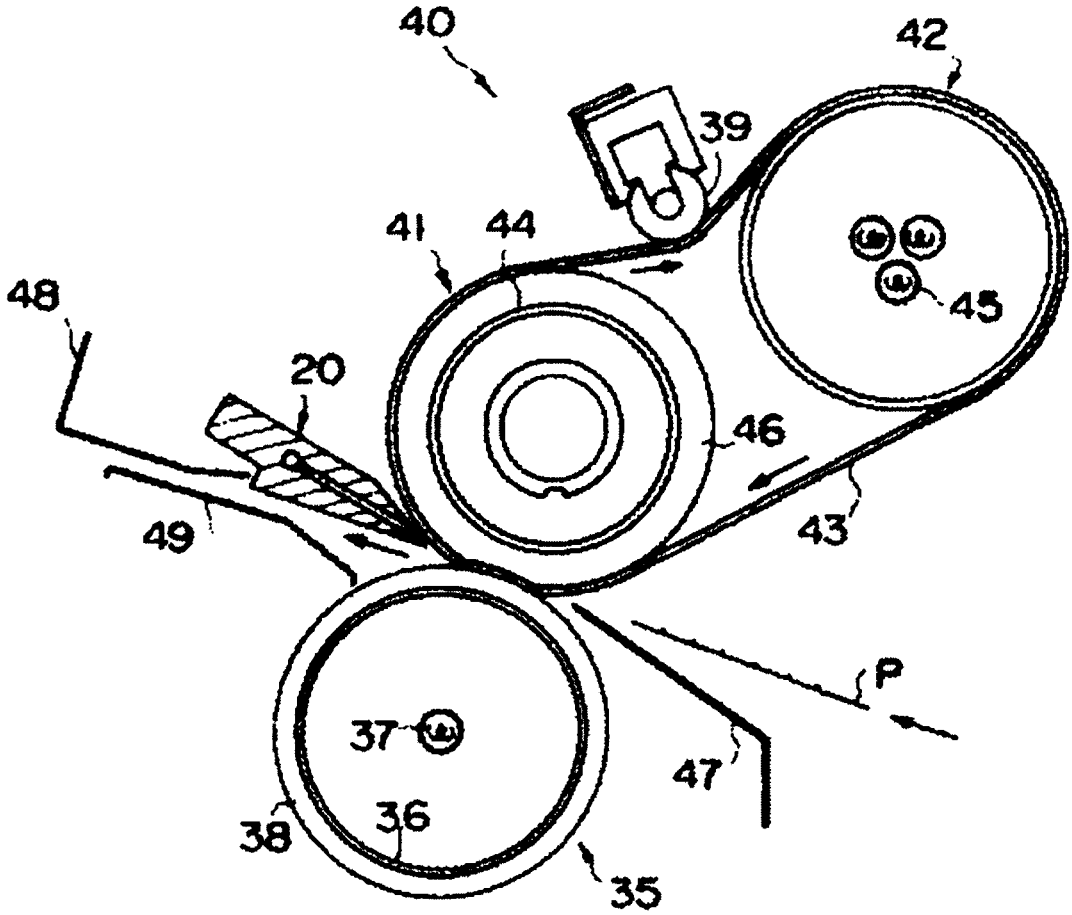
FIG. 2 is a cross-sectional view of one exemplary fixing unit in an image forming apparatus according to the present invention.

FIG. 2 is a cross-sectional view of one exemplary fixing unit in the image forming apparatus according to the present invention. A fixing unit 40 has a configuration based on the belt fixing method. In the belt fixing method, the surface heat capacity is made small and the surface can be increased in temperature immediately after the switch is on. As a result, since the warm-up time can be shortened, the belt fixing method is preferred in terms of energy saving. Moreover, the belt fixing method is preferred from the viewpoint of the following. Specifically, separability of paper from a fixing roller 41 and a fixing belt 43 can be increased by making the surface hardness of the fixing roller 41 lower than the surface hardness of the pressing roller (rotatable pressing member) 35 through thickening a rubber layer 46 in the fixing roller 41 and by adjusting downward the direction in which the paper is discharged from the nip between the pressing roller 35 and the fixing roller 41.

The surface hardness of the fixing roller, the thickness of the rubber layer of the fixing roller, the surface hardness of the pressing roller and the size of the nip portion are not particularly limited and may be appropriately selected depending on the intended purpose.

Also, the difference in surface hardness between the fixing roller and the pressing roller is not particularly limited and may be appropriately selected depending on the intended purpose.

Notably, if an air separation member 20 has a sufficient separation performance as in the example of FIG. 2, the surface hardnesses of the fixing roller 41 and the pressing roller 35 may be made equal and the paper may be discharged in the tangential direction of the nip portion between the rollers.

The surface of the fixing belt 43 is heated by three heaters 45 build in a heating roller (rotatable heating member) 42. The heated fixing belt 43 heats and presses an unfixed image at the fixing nip between the fixing roller 41 and the pressing roller 35, to thereby fix an image.

The material for the fixing belt is not particularly limited and may be appropriately selected depending on the intended purpose. The fixing belt is preferably a belt containing a polyimide film (base) and silicone rubber covering the film.

The thickness of the fixing belt, the thickness of the base in the fixing belt and the thickness of the silicone rubber layer are not particularly limited and may be appropriately selected depending on the intended purpose.

The fixing roller 41 has a roller metal core 44 and a rubber layer 46 on the roller metal core. The fixing belt 43 wound around the fixing roller 41 and the heating roller 42 is stretched by a belt tension 39 in a predetermined degree. The pressing roller 35 has a metal core 36 and a rubber layer 38 on the metal core, and has a heater 37 therein. The heater 37 is provided in order for the pressing roller 35 to be able to heat for preventing the temperature at the fixing nip portion from decreasing. The material for the rubber layers 46 and 38 is silicone rubber which can improve heat resistance and color developability of an image. By making the rubber layers 46 and 38 to have different thicknesses; i.e., making the rubber layer 46 of the fixing roller 41 thicker than the rubber layer 38, the pressing roller 35 is made to intrude in the fixing roller 41.

In this unit, both the surfaces of the fixing belt 43 and the pressing roller 35 are formed of silicone rubber having tackiness. Thus, a small amount of silicone oil is applied to the surface of the fixing belt 43 in order for a paper sheet P to be easily peeled off. A fixing inlet guiding plate 47 is disposed upstream of the fixing nip portion and guides the paper sheet P to the fixing nip portion. After discharged from the fixing nip portion, the paper sheet P is guided under the air separation member 20 and passed through the space between the air separation member 20 and a lower discharge guide 49. Then, the paper sheet P is discharged through the space between an upper discharge guide 48 and the lower discharge guide 49.

Figure 3A:
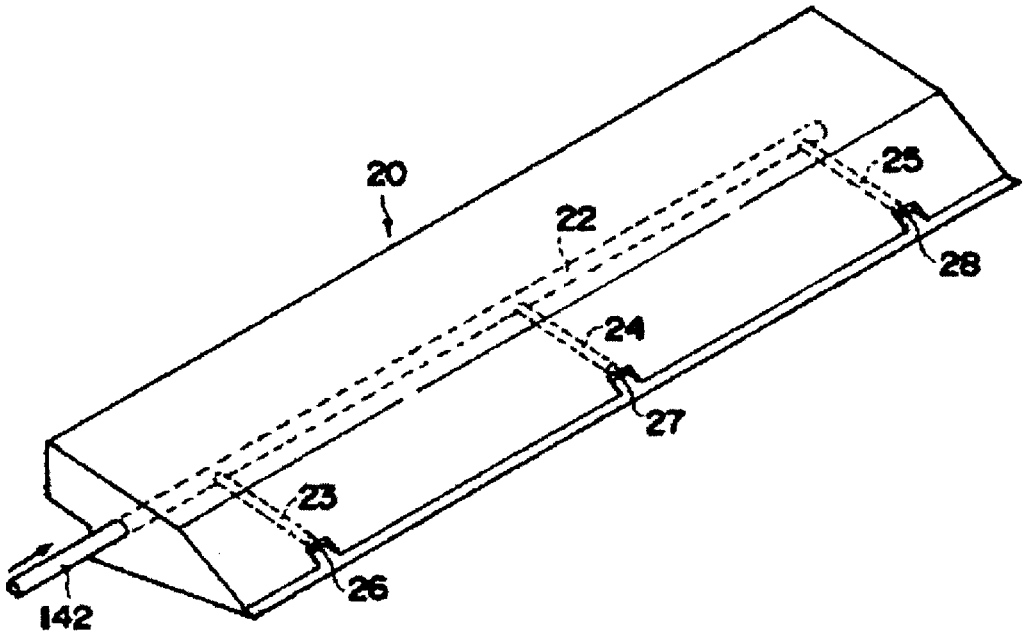
FIG. 3A is a perspective view of one exemplary paper-separating unit in an image forming apparatus according to the present invention.
Figure 3B:
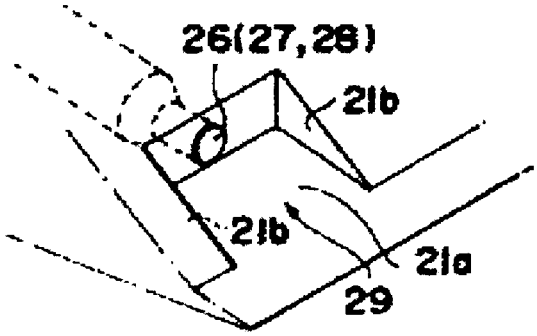
FIG. 3B is an enlarged perspective view of the air-discharging port illustrated in FIG. 3A.
Figure 4:
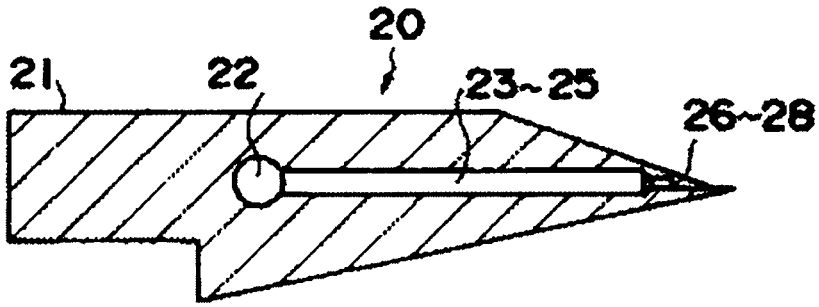
FIG. 4 is a cross-sectional view of one exemplary paper-separating unit in an image forming apparatus of the present invention.

FIG. 3A is a perspective view of one example of the air separation member 20. FIG. 3B is an enlarged perspective view of the air-discharging port illustrated in FIG. 3A. FIG. 4 is a cross-sectional view of one exemplary paper-separating unit.

A nozzle main body 21 of the air separation member 20 has a pipe line 22 therein that extends in the longitudinal direction. The pipe line 22 is branched at three points; i.e., the central portion and both the end portions in the longitudinal direction of the air separation member 20, to form branched pipe lines 23, 24 and 25 extending toward the tips of nozzles. Each of the tips of the branched pipe lines 23, 24 and 25 has a small diameter so as to form nozzles 26, 27 and 28 serving as air-discharging ports. As illustrated in FIG. 4, the tip of the nozzle main body 21 is sharp; i.e., the nozzle main body has a cross-sectional shape whose tip forms an acute angle. An air-discharging port 29 is provided at the tip thereof and defined by a bottom surface 21*a* provided at the tip of the nozzle main body 21 and side surfaces 21*b* located at the both sides of the nozzle. Using the bottom and side surfaces, the air-discharging port 29 confines in three directions air discharged from the nozzles 26, 27 and 28 to successfully guide the air toward the fixing nip without diffusion of the air. Also, one end of the pipe line 22 is open at the end surface of the nozzle main body 21 and an air tube 142 is fitted into the pipe line 22.

The air tube 142 is connected to an air-feeding port 141 of an air-feeding device 500 described below. The air tube 142 jets air fed from the air-feeding device 500 from the nozzles 26, 27 and 28 to separate (air separate) a paper sheet discharged from the fixing nip portion.

In this example, by confining the air-discharging port 29 in three directions to guide the air discharged from each nozzle as described above, the discharged air goes straight toward the nip portion to exhibit strong impact, which can assuredly separate the paper sheet.

The speed at which the air is discharged not particularly limited and may be appropriately selected depending on the intended purpose.

<Charge-Eliminating Step and Charge-Eliminating Unit>

The charge-eliminating step is a step of charge-eliminating the photoconductor by applying charge-eliminating bias thereto, and can be suitably performed by a charge-eliminating unit.

The charge-eliminating unit is not particularly limited, so long as it can apply charge-eliminating bias to the photoconductor, and may be appropriately selected from known charge-eliminating devices. Preferred examples thereof include a charge-eliminating lamp.

<Cleaning Step and Cleaning Unit>

The cleaning step is a step of removing the toner remaining on the photoconductor, and can be suitably performed by a cleaning unit. Notably, instead of the cleaning unit, a sliding member may be used to make the residual toner to have the same charge and the thus-treated toner may be recovered by a developing roller.

The cleaning unit is not particularly limited, so long as it can remove the electrophotographic toner remaining on the photoconductor, and may be appropriately selected from known cleaners. Preferred examples thereof include a magnetic brush cleaner, an electrostatic brush cleaner, a magnetic roller cleaner, a blade cleaner, a brush cleaner and a web cleaner.

<Recycling Step and Recycling Unit>

The recycling step is a step of recycling the toner removed at the cleaning step to developing unit, and can be suitably performed by a recycling unit. The recycling unit is not particularly limited and may be a known conveying unit, for example.

<Controlling Step and Controlling Unit>

The controlling step is a step of controlling each of the above steps, and can be suitably performed by a controlling unit.

The controlling unit is not particularly limited, so long as it can control the operation of each unit, and may be appropriately selected depending on the intended purpose. Examples thereof include devices such as a sequenser and a computer.

Next, an image forming apparatus of the present invention will be described in detail with reference to the drawings. The image forming apparatus of the present invention should not be construed as being limited thereto.

FIG. 1 is a cross-sectional view of one exemplary image forming apparatus according to the present invention.

An image forming apparatus illustrated in FIG. 1 is configured to be a so-called tandem-type full-color printer, and includes four image forming units 2M, 2C, 2Y and 2Bk arranged in parallel along the lower moving side of an intermediate transfer belt 1. Also, a photoscanning device 30 is disposed under the four image forming units 2M, 2C, 2Y and 2Bk. Furthermore, a paper-feeding cassette 12 is disposed under the photoscanning device 30. A paper-feeding unit 13 is provided at one end of the paper-feeding cassette 12 for feeding a recording medium P (e.g., a transfer target) housed in the paper-feeding cassette 12. Registration rollers 14 are provided above the paper-feeding unit 13. Above the registration rollers 14 is provided a transfer roller 15 serving as a secondary transfer unit. Moreover, a fixing unit 40 is disposed above the secondary transfer portion at which the transfer roller 15 is pressed against the intermediate transfer belt 1. From the cross-sectional view illustrated in FIG. 1, an air-feeding device 500 for feeding air used for air separation in the fixing unit 40 is provided at the left side of the fixing unit 40. The top surface of the image forming apparatus is configured as a paper-discharging tray 17. Also, there is provided a paper-discharging roller 18 for discharging a transfer target after fixing to the paper-discharging tray 17.

The four image-forming units 2M, 2C, 2Y and 2Bk have substantially the same configuration and operation, except that the color of the toner used is different among them; i.e., magenta (M), cyan (C), yellow (Y) or black (Bk). Thus, the image-forming unit 2M provided on the extreme left will be described as an example. Here, reference characters denoting the colors of toner are omitted.

The image-forming unit 2 includes a photoconductor drum 3 serving as a latent electrostatic image bearing member. The photoconductor drum 3 is rotated clockwise in the figure by a driving unit. Around the photoconductor drum 3 are provided a charging roller 4, a developing device 5, a cleaning device 6, etc. The developing device 5 is a developing device containing a two-component developer of toner and carrier, and applies the toner carried on a developing sleeve to the photoconductor drum 3. Also, a transfer roller 7 serving as a primary transfer unit is disposed so as to face the photoconductor drum 3 via the intermediate transfer belt 1.

The intermediate transfer belt 1 is supported by several supporting rollers in a stretched manner, and moved counterclockwise in FIG. 1 indicated by the arrow in FIG. 1. One of the supporting rollers is a facing roller 8 which is disposed so as to face the secondary transfer roller 15. An intermediate transfer belt cleaning device 19 is provided such that it is pressed against the intermediate transfer belt 1 at the supporting roller 9 disposed opposite to the facing roller 8.

The photoscanning device 30 is configured such that scanning light is applied to the four image-forming units 2M, 2C, 2Y and 2Bk. The photoscanning device (exposing device) 30 has a polygon mirror 31 serving as a rotary optical deflector, fθ lenses 32, toroidal lenses 33 and a group of mirrors 34.

The printing operation of the full-color printer having the above configuration will be briefly described.

In the image-forming unit 2M for magenta toner, the surface of the photoconductor drum 3 is uniformly charged at a predetermined potential with a charging roller 4. In the exposing device 30, a LD (laser diode) is driven based on image data sent from a host machine (e.g., a personal computer) to apply laser lights to the polygon mirror 31; the reflected light is guided toward the photoconductor drum 3M via a cylinder lens, etc. to form a latent electrostatic image to be developed with magenta toner on the photoconductor drum 3M. The magenta toner is applied to the formed latent image from the developing device 5 to form a visible image of magenta toner.

Similar to the formation of the magenta toner image, also in the other image-forming units 2C, 2Y and 2Bk, visible images of the corresponding color toners are formed on the surfaces of the photoconductor drums 3. Then, these visible images are transferred onto the intermediate transfer roller 1 in a superposed manner.

Also, a paper sheet used as a transfer target is fed from the paper-feeding portion 12 and stopped by a pair of registration rollers 14 provided upstream in the paper-feeding direction. Then, in synchronization with the visible image, the paper sheet is fed to the secondary transfer position at which the secondary transfer roller 15 is pressed against the intermediate transfer belt 1, where the toner image is transferred onto the paper sheet by the action of the secondary transfer roller 15.

In the case of monochromatic printing, only in the image-forming unit 2Bk for black toner, a visible image of black toner is formed on the surface of the image photoconductor drum 3, and the formed Bk toner image is transferred onto a paper sheet.

The paper sheet to which the toner image has been transferred is fixed with the fixing unit 40, and then discharged toward the paper-discharging tray 17 provided on the upper surface of the main body of the apparatus. Paper sheets are reversed before discharging. By reversing before discharging, paper sheets printed in the order of page can be stacked on top of another in the order of page.

EXAMPLES

The present invention will next be described in detail by way of Examples and Comparative Examples. The present invention should not be construed as being limited thereto. In the following Examples and Comparative Examples, the unit "part(s)" means "part(s) by mass" and the unit "%" means "% by mass" unless otherwise specified.

Production Example 1

Synthesis of Fine Particle Dispersion Liquid 1

Organic Fine Particle Emulsion

[Composition]
Water: 700 parts
Sodium salt of sulfuric acid ester of methacrylic acid-ethylene oxide adduct (Eleminol RS-30, product of Sanyo Chemical Industries, Ltd.): 12 parts
Styrene: 140 parts
Methacrylic acid: 140 parts
Ammonium persulfate: 1.5 parts The above materials for [fine particle dispersion liquid 1] having the above composition were added to a reaction container to which a stirring rod and a thermometer had been set. The resultant mixture was stirred at 450 rpm for 20 min to obtain a white emulsion. The obtained white emulsion was heated so that the system was increased in temperature to 75° C., followed by reaction for 5 hours. Moreover, 1% aqueous ammonium persulfate solution (35 parts) was added thereto, and the resultant mixture was aged at 75° C. for 5 hours, to thereby obtain aqueous dispersion liquid [fine particle dispersion liquid 1] of a vinyl resin (copolymer of styrene-methacrylic acid-sodium salt of sulfuric acid ester of methacrylic acid-ethylene oxide adduct).

The obtained [fine particle dispersion liquid 1] was measured for volume average particle diameter with a laser diffraction/scattering particle size analyzer (LA-920, HORIBA, Ltd.), and was found to have a volume average particle diameter of 0.30 μm. Part of the [fine particle dispersion liquid 1] was dried to isolate resin. Using a differential scanning calorimeter (TG-DSC system TAS-100 device, product of Rigaku Corporation), the resin was measured for maximum endothermic peak temperature through differential scanning calorimetry (DSC) (glass transition temperature (Tg)), and was found to have a maximum endothermic peak temperature of 155° C.

Production Example 2

Preparation of Aqueous Phase 1

[Composition]
Water: 1,000 parts
[Fine particle dispersion liquid 1] obtained in Production Example 1: 85 parts
50% aqueous solution of sodium dodecyldiphenylethersulfonate (Eleminol MON-7, product of Sanyo Chemical Industries, Ltd.): 40 parts Ethyl acetate: 95 parts The materials for [aqueous phase 1] having the above composition were mixed together under stirring to obtain an opaque white liquid, which was used as [aqueous phase 1].

Production Example 3

Synthesis of Low-Molecular-Weight Polyester 1

[Composition]
Bisphenol A ethylene oxide 2 mol adduct: 235 parts
Bisphenol A propylene oxide 3 mol adduct: 535 parts
Terephthalic acid: 215 parts
Adipic acid: 50 parts
Dibutyltinoxide: 3 parts The materials for [low-molecular-weight polyester 1] having the above composition was added to a reaction container equipped with a condenser, a stirrer and a nitrogen-introducing tube, followed by reaction at 240° C. for 10 hours under normal pressure. Further, the reaction mixture was allowed to react for 6 hours at a reduced pressure of 10 mmHg to 20 mmHg. Then, trimellitic anhydride (45 parts) was added to the reaction container, followed by reaction at 185° C. for 3 hours under normal pressure, to thereby obtain [low-molecular-weight polyester 1].

The [low-molecular-weight polyester 1] was found to have a number average molecular weight of 2,800, a weight average molecular weight of 7,100, a Tg of 45° C. and an acid value of 22 mgKOH/g.

Notably, the number average molecular weight and the weight average molecular weight were measured through gel permeation chromatography (GPC) (measurement apparatus: GPC-150C (product of Waters Co.) and column: KF801 to 807 (product of Shodex Co.)). The Tg was measured by the same method as in Production Example 1. Also, the acid value was measured by the method according to JIS K0070. When the obtained [low-molecular-weight polyester 1] was not dissolved, a solvent such as dioxane or THF was used.

Production Example 4

Synthesis of Polyester Prepolymer 1 [Intermediate Polyester 1]

Isocyanate Group-Containing Polyester Prepolymer

[Composition]
Bisphenol A ethylene oxide 2 mol adduct: 700 parts
Bisphenol A propylene oxide 2 mol adduct: 85 parts
Terephthalic acid: 300 parts
Trimellitic anhydride: 25 parts
Dibutyltinoxide: 3 parts The materials for [intermediate polyester 1] were added to a reaction container equipped with a condenser, a stirrer and a nitrogen-introducing tube, followed by reaction at 240° C. for 10 hours under normal pressure. The reaction mixture was allowed to further react for 6 hours at a reduced pressure of 10 mmHg to 20 mmHg, to thereby obtain [intermediate polyester 1].

The number average molecular weight, weight average molecular weight, Tg and acid value of [intermediate polyester 1] were measured in the same manner as in Production Example 3. Also, the hydroxyl value thereof was measured by the measurement method according to JIS K0070. As a result, [intermediate polyester 1] was found to have a number average molecular weight of 2,500, a weight average molecular weight of 10,000, a Tg of 58° C., an acid value of 0.5 mgKOH/g and a hydroxyl value of 52 mgKOH/g.

Next, [intermediate polyester 1] (400 parts), isophoron diisocyanate (90 parts) and ethyl acetate (500 parts) were added to a reaction container equipped with a condenser, a stirrer and a nitrogen-introducing tube, followed by reaction at 110° C. for 6 hours, to thereby obtain [prepolymer 1]. The amount of the free isocyanate contained in [prepolymer 1] was found to be 1.67% by mass.

Production Example 5

Synthesis of Crystalline Polyester Resin 1

[Composition]
1,4-Butanediol: 28 mol
Fumaric acid: 24 mol
Trimellitic acid: 1.80 mol
Hydroquinone: 6.0 g The materials for the [crystalline polyester resin 1] were added to a 5 L four-necked flask equipped with a nitrogen-introducing tube, a dehydration tube, a stirrer and a thermocouple, followed by reaction at 160° C. for 6 hours. Thereafter, the reaction mixture was allowed to react at 200° C. for 1 hour and further react at 8.3 kPa for 1 hour, to thereby obtain [crystalline polyester resin 1].

The number average molecular weight, weight average molecular weight and Tg of the [crystalline polyester resin 1] were measured in the same manner as in Production Example 3. As a result, the [crystalline polyester resin 1] was found to have a number average molecular weight of 800, a weight average molecular weight of 3,000 and a Tg of 150° C.

Production Example 5-2

Synthesis of Crystalline Polyester Resin 2

[Composition]
1,4-Butanediol: 28 mol
Fumaric acid: 24 mol
Trimellitic anhydride: 1.80 mol
Hydroquinone: 6.0 g The materials for [crystalline polyester resin 1] were added to 5 L four-necked flask equipped with a nitrogen-introducing tube, a dehydration tube, a stirrer and a thermocouple, followed by reaction at 120° C. for 3 hours. Thereafter, the reaction mixture was allowed to react at 180° C. for 0.5 hours and further react at 8.3 kPa for 0.5 hours, to thereby obtain [crystalline polyester resin 2].

The number average molecular weight, weight average molecular weight and Tg of the [crystalline polyester resin 2] were measured in the same manner as in Production Example 3. As a result, the [crystalline polyester resin 2] was found to have a number average molecular weight of 500, a weight average molecular weight of 1,000 and a Tg of 50° C.

Production Example 6

Synthesis of Ketimine Compound 1

[Composition]
Isophorondiamine: 180 parts
Methyl ethyl ketone: 80 parts

The materials for [ketimine compound 1] having the above composition were added to a reaction container to which a stirring rod and a thermometer had been set, followed by reaction at 50° C. for 6 hours, to thereby obtain [ketimine compound 1].

The [ketimine compound 1] was found to have an amine value of 420 mgKOH/g.

Production Example 7

Synthesis of Masterbatch (MB) 1

[Composition]
Water: 1,300 parts
Carbon black (Printex35, product of Deggusa Co.) (DBP oil-absorption amount=43 mL/100 mg, pH=9.5): 550 parts
Polyester: 1,300 parts The materials for [masterbatch 1] having the above composition were mixed together with HENSCHEL MIXER (product of Mitsui Mining Co.). Using a two-roll mill, the resultant mixture was kneaded at 160° C. for 45 min, followed by calendaring, cooling and pulverizing with a pulverizer, to thereby obtain [masterbatch 1].

Production Example 8

Preparation of Oil Phase

Pigment•WAX Dispersion Liquid 1

[Composition]
[Low-molecular-weight polyester 1]: 400 parts
Microcrystalline wax (acid value: 0.1 mgKOH/g, melting point: 65° C., the number of carbon atoms: 20 and linear hydrocarbon: 70%): 100 parts CCA (salicylic acid metal complex E-84 (product of Orient Chemical Industries, Ltd.): 20 parts Ethyl acetate: 1,000 parts

[Raw material solution 1] having the above composition was added to a container to which a stirrer and a thermometer had been set. The resultant mixture was increased in temperature to 80° C. under stirring and maintained at 80° C. for 8 hours, followed by cooling to 24° C. over 1 hour. Next, [masterbatch 1] (480 parts) and ethyl acetate (550 parts) were added to the container, followed by mixing for 1 hour, to thereby obtain [raw material solution 1].

The [raw material solution 1] was placed in another container, where the carbon black and the WAX were dispersed using a bead mill (Ultra Visco Mill, product of Aymex Co.) under the following conditions: liquid-feeding rate: 1 kg/hour; disc circumferential speed: 6 m/sec; amount of 0.5 mm-zirconia beads charged: 80% by volume; and pass time: 3. Next, 1,000 parts of 65% ethyl acetate solution of [low-molecular-weight polyester 1] was added thereto and passed with the bead mill once under the above conditions, to thereby obtain [pigment•WAX dispersion liquid 1]. The concentration of the solid content of the [pigment•WAX dispersion liquid 1] was found to be 53% (130° C., 30 min).

Production Example 9

Preparation of Oil Phase

Pigment•WAX Dispersion Liquid 2

The procedure of Production Example 8 was repeated, except that the microcrystalline wax used in Production Example 8 for preparing [pigment•WAX dispersion liquid 1] was changed to a microcrystalline having an acid value of 0.1 mgKOH/g, a melting point of 90° C., 80 carbon atoms, and a linear hydrocarbon in an amount of 55%, to thereby obtain [pigment•WAX dispersion liquid 2].

Production Example 10

Preparation of Oil Phase

Pigment•WAX Dispersion Liquid 3

The procedure of Production Example 8 was repeated, except that the microcrystalline wax used in Production Example 8 for preparing [pigment•WAX dispersion liquid 1] was changed to a microcrystalline having 85 carbon atoms and a linear hydrocarbon in an amount of 50%, to thereby obtain [pigment•WAX dispersion liquid 3].

Production Example 11

Preparation of Crystalline Polyester Resin Dispersion Liquid 1

The [crystalline polyester resin 1] (110 g) and ethyl acetate (450 g) were added to a 2 L metal container. The resultant mixture was dissolved or dispersed at 80° C. under heating and then quenched in an ice-water bath. Subsequently, glass beads (3 mm in diameter) (500 mL) were added to the mixture, followed by stirring for 10 hours with a batch-type sand mill (product of Kanpe Hapio Co., Ltd.), to thereby obtain [crystalline polyester resin dispersion liquid 1] having a volume average particle diameter of 0.4 μm.

Example 1

Preparation of Toner Base Particles 1

The following emulsion dispersion step, desolvation step, washing step and drying step were performed to obtain toner base particles 1.

—Emulsion Dispersion Step—

[Composition]

[Pigment•WAX dispersion liquid 1]: 700 parts

[Prepolymer 1]: 120 parts

[Crystalline polyester resin dispersion liquid 1]: 80 parts

[Ketimine compound 1]: 5 parts

The materials for [emulsified slurry 1] having the above composition were added to a container and were mixed together using a TK homomixer (product of PRIMIX Corporation) at 6,000 rpm for 1 min. The [aqueous phase 1] (1,300 parts) was added to the container, followed by mixing using a TK homomixer at 13,000 rpm for 20 min, to thereby obtain [emulsified slurry 1].

—Desolvation Step—

The [emulsified slurry 1] was added to a container to which a stirrer and a thermometer had been set. The [emulsified slurry 1] was desolvated at 30° C. for 10 hours and aged at 45° C. for 5 hours, to thereby obtain [dispersion slurry 1].

—Washing Step and Drying Step—

The [emulsified slurry 1] (100 parts) was filtrated under reduced pressure and then subjected twice to a series of treatments (1) to (4) described below, to thereby obtain [filtration cake 1]:

(1): ion-exchanged water (100 parts) was added to the filtration cake, followed by mixing with a TK homomixer (at 12,000 rpm for 10 min) and then filtration;

(2): 10% aqueous sodium hydroxide solution (100 parts) was added to the filtration cake obtained in (1), followed by mixing with a TK homomixer (at 12,000 rpm for 30 min) and then filtration under reduced pressure;

(3): 10% hydrochloric acid (100 parts) was added to the filtration cake obtained in (2), followed by mixing with a TK homomixer (at 12,000 rpm for 10 min) and then filtration; and (4): ion-exchanged water (300 parts) was added to the filtration cake obtained in (3), followed by mixing with a TK homomixer (at 12,000 rpm for 10 min) and then filtration.

[Filtration cake 1] was dried with an air-circulating drier at 45° C. for 48 hours, and then was caused to pass through a sieve with a mesh size of 75 μm, to thereby prepare [toner base particles 1].

The above-obtained [toner base particles 1] (100 parts), hydrophobic silica (0.7 parts) and hydrophobic titanium oxide (0.3 parts) were mixed together with HENSCHEL MIXER to form a toner containing the base particles. The thus-formed toner was measured for W/R, through FT-IR under the measurement conditions previously described in the specification.

The toner was treated with external additives and mixed with silicone resin-coated copper-zinc ferrite carriers having an average particle diameter of 40 μm (toner:carrier=5%:95%) to prepare a developer. The thus-prepared developer was set in RICOH Pro c900s (product of Ricoh Company, Ltd.); i.e., a remodeled machine containing the air separation fixing unit described in the present invention and the image forming apparatus of the present invention. The machine containing the developer was caused to perform continuous printing. The developer was evaluated based on the following criteria. The results are shown in Table 1.

Evaluation

A blue solid image of SRA3 size was formed on Ricoh copy paper 180K. The formed image was visually evaluated for uneven image glossiness and solid image's surface roughness based on the following evaluation criteria.

Notably, glossiness unevenness becomes significant when paper separability is poor so that the paper is wound around the heat roller. The solid image's surface roughness becomes significant when the releasing agent is difficult to exude on the surface from the interior of the toner due to air during fixing.

[Evaluation Criteria of Image Glossiness Unevenness]

A: No glossiness unevenness was observed.

B: Glossiness unevenness was slightly observed, but allowable.

C: Glossiness unevenness was observed when carefully observing the image with the naked eyes.

D: Glossiness unevenness was easily observed with the naked eyes.

[Solid Image's Surface Roughness]

A: No surface roughness was observed.

B: Surface roughness was slightly observed, but allowable.

C: Surface roughness was observed when carefully observing the image with the naked eyes.

D: Surface roughness was easily observed with the naked eyes.

Example 2

The procedure of Example 1 was repeated, except that the [crystalline polyester resin dispersion liquid 1] (80 parts) was changed to [crystalline polyester resin dispersion liquid 1] (5 parts), to thereby obtain [toner base particles 2].

In addition, the obtained [toner base particles 2] were measured for W/R and evaluated in the same manner as in Example 1, except that the [toner base particles 1] were changed to [toner base particles 2]. The results are shown in Table 1.

Comparative Example 1

The [toner base particles 1] were evaluated in the same manner as in Example 1, except that the air-jetting function of the RICOH Pro c900s machine (product of Ricoh, Company Ltd.) was stopped. The results are shown in Table 1.

Comparative Example 2

The procedure of Example 1 was repeated, except that the [crystalline polyester resin dispersion liquid 1] (80 parts) was changed to [crystalline polyester resin dispersion liquid 1] (4 parts), to thereby obtain [toner base particles 3].

In addition, the obtained [toner base particles 3] were measured for W/R, and evaluated in the same manner as in Example 1, except that the [toner base particles 1] were changed to [toner base particles 3]. The results are shown in Table 1.

Example 3

The procedure of Example 1 was repeated, except that [pigment•WAX dispersion liquid 1] (700 parts) was changed to [pigment•WAX dispersion liquid 2] (700 parts), to thereby obtain [toner base particles 4].

In addition, the obtained [toner base particles 4] were measured for W/R, and evaluated in the same manner as in Example 1, except that the [toner base particles 1] were changed to [toner base particles 4]. The results are shown in Table 1.

Example 4

The procedure of Example 1 was repeated, except that [pigment•WAX dispersion liquid 1] (700 parts) was changed to [pigment•WAX dispersion liquid 1] (50 parts), to thereby obtain [toner base particles 5]

In addition, the obtained [toner base particles 5] were measured for W/R, and evaluated in the same manner as in Example 1, except that the [toner base particles 1] were changed to [toner base particles 5]. The results are shown in Table 1.

Example 5

The procedure of Example 1 was repeated, except that [crystalline polyester resin dispersion liquid 1] was changed to [crystalline polyester resin dispersion liquid 2], to thereby obtain [toner base particles 6].

In addition, the obtained [toner base particles 6] were measured for W/R and evaluated in the same manner as in Example 1, except that the [toner base particles 1] were changed to [toner base particles 6]. The results are shown in Table 1.

Example 6

The procedure of Example 1 was repeated, except that [pigment•WAX dispersion liquid 1] was changed to [pigment•WAX dispersion liquid 3], to thereby obtain [toner base particles 7].

In addition, the obtained [toner base particles 7] were measured for W/R and evaluated in the same manner as in Example 1, except that the [toner base particles 1] were changed to [toner base particles 7]. The results are shown in Table 1.

Example 7

The procedure of Example 1 was repeated, except that the [crystalline polyester resin dispersion liquid 1] (80 parts) was changed to [crystalline polyester resin dispersion liquid 1] (40 parts), to thereby obtain [toner base particles 8].

In addition, the obtained [toner base particles 8] were measured for W/R, and evaluated in the same manner as in Example 1, except that the [toner base particles 1] were changed to [toner base particles 8]. The results are shown in Table 1.

TABLE 1

| | W/R | Number of carbon atoms | Linear hydrocarbon (%) | Amount of releasing agnet in toner base particles (%) | Melting point of releasing agent (° C.) | Endothermic peak temp. of crystalline polyester resin (° C.) | Image glossiness unevenness | Solid image's surface roughness |
|---|---|---|---|---|---|---|---|---|
| Ex. 1 | 0.85 | 20 | 70 | 20 | 65 | 150 | A | A |
| Comp. Ex. 1 | 0.85 | 20 | 70 | 20 | 65 | 150 | D | A |
| Ex. 2 | 0.045 | 20 | 70 | 20 | 65 | 150 | A | B |
| Comp. Ex. 2 | 0.042 | 20 | 70 | 20 | 65 | 150 | B | D |
| Ex. 3 | 0.84 | 80 | 55 | 20 | 90 | 150 | A | B |

TABLE 1-continued

| | W/R | Number of carbon atoms | Linear hydrocarbon (%) | Amount of releasing agnet in toner base particles (%) | Melting point of releasing agent (° C.) | Endothermic peak temp. of crystalline polyester resin (° C.) | Image glossiness unevenness | Solid image's surface roughness |
|---|---|---|---|---|---|---|---|---|
| Ex. 4 | 0.849 | 20 | 70 | 1 | 65 | 150 | B | B |
| Ex. 5 | 0.845 | 20 | 70 | 20 | 65 | 50 | A | A |
| Ex. 6 | 0.85 | 85 | 50 | 20 | 65 | 150 | B | C |
| Ex. 7 | 0.42 | 20 | 70 | 20 | 65 | 150 | A | A |

INDUSTRIAL APPLICABILITY

The image forming apparatus and the image forming method of the present invention can improve paper separability by air separation to prevent winding jam from occurring, can prevent the exudation of the releasing agent on the toner surface from being inhibited by air, and can prevent glossiness unevenness and solid image's surface roughness. Thus, they are suitably applicable to image forming processes in, for example, high-quality copiers, electrostatic printing, printers and electrostatic recording.

This application claims priority to Japanese patent application No. 2010-162044, filed on Jul. 16, 2010, and incorporated herein by reference.

What is claimed is:

1. An image forming apparatus comprising:

a latent electrostatic image bearing member, a latent electrostatic image forming unit configured to form a latent electrostatic image on the latent electrostatic image bearing member, a toner, a developing unit configured to develop the latent electrostatic image with the toner to form a visible image, a transfer unit configured to transfer the visible image onto the recording medium, and a fixing unit configured to fix the transferred visible image on a recording medium, wherein the fixing unit comprises a rotatable heating member which heats the recording medium having the unfixed visible image, a rotatable pressing member which comes into contact with the rotatable heating member to form a nip portion, and an air separation member which separates the recording medium from the rotatable heating member by air, wherein the toner comprises toner base particles each comprising at least a binder resin and a releasing agent, wherein the binder resin comprises at least a crystalline polyester resin and a non-crystalline resin, wherein a ratio of W/R is 0.045 to 0.85, where W denotes a peak height in a spectrum of the crystalline polyester resin, R denotes a peak height in a spectrum of the non-crystalline resin, and each of the spectra is measured by a total transmission method (KBr method) using a Fourier transform infrared (FT-IR) spectrometer, and wherein the releasing agent is a microcrystalline wax comprising C20-C80 hydrocarbons, where the releasing agent comprises 55 to 70 mass % of a linear hydrocarbon based on a total amount of hydrocarbons in the releasing agent, and the releasing agent has a melting point of 65° C. to 90° C. where the melting point is defined as a maximum endothermic peak temperature measured through differential scanning calorimetry (DSC).

2. The image forming apparatus according to claim 1, wherein the toner comprises 1 to 20 mass % of the releasing agent, based on a total amount of the toner base particles.

3. The image forming apparatus according to claim 1, wherein the crystalline polyester resin has a melting point of 50° C. to 150° C. where the melting point is defined as a maximum endothermic peak temperature measured through differential scanning calorimetry (DSC).

4. The image forming apparatus according to claim 1, wherein the toner is obtained by a production method comprising:

dissolving or dispersing in an organic solvent toner materials comprising at least the binder resin and the releasing agent to obtain a toner material liquid which is an oil phase, and emulsifying or dispersing the oil phase in an aqueous medium which is an aqueous phase, and removing the organic solvent to form the toner base particles.

5. The image forming apparatus according to claim 1, wherein the air separation member comprises a plurality of independent air-discharging ports in a longitudinal direction.

6. The image forming apparatus according to claim 5, wherein the air-discharging ports are disposed at three positions of the air separation member: a center portion and each of two end portions.

7. The image forming apparatus according to claim 6, wherein each air-discharging port is confined toward the nip portion.

8. The image forming apparatus according to claim 1, wherein the releasing agent comprises 60 to 70 mass % of the linear hydrocarbon based on a total amount of hydrocarbons in the releasing agent.

9. The image forming apparatus according to claim 1, wherein the releasing agent has a melting point of 75° C. to 85° C.

10. The image forming apparatus according to claim 1, wherein the toner comprises 1 to 10 mass % of the releasing agent, based on a total amount of the toner base particles.

11. The image forming apparatus according to claim 1, wherein the crystalline polyester resin has a weight average molecular weight (Mw) of 1000 to 6500, a number average molecular weight (Mn) of 500 to 2000, and a ratio Mw/Mn is in a range of 2 to 5.

12. An image forming method comprising:

forming a latent electrostatic image on a latent electrostatic image bearing member, developing the latent electrostatic image with a toner to form a visible image, transferring the visible image onto a recording medium, and fixing the transferred visible image on the recording medium, wherein the fixing is performed with a fixing unit comprising a rotatable heating member which heats the recording medium having the unfixed visible image, a rotatable pressing member which comes into contact with the rotatable heating member to form a nip portion, and an air separation member which separates the recording medium from the rotatable heating member by air, wherein the toner comprises toner base particles each comprising at least a binder resin and a releasing agent, wherein the binder resin comprises at least a crystalline polyester resin and a non-crystalline resin, wherein a ratio of W/R is 0.045 to 0.85, where W denotes a peak height in a spectrum of the crystalline polyester resin, R denotes a peak height in a spectrum of the non-crystalline resin, and each of the spectra is measured by a total transmission method (KBr method) using a Fourier transform infrared (FT-IR) spectrometer, and wherein the releasing agent is a microcrystalline wax comprising C20-C80 hydrocarbons, where the releasing agent comprises 55 to 70 mass % of a linear hydrocarbon based on a total amount of hydrocarbons in the releasing agent, and the releasing agent has a melting point of 65° C. to 90° C. where the melting point is defined as a maximum endothermic peak temperature measured through differential scanning calorimetry (DSC).

13. The image forming method according to claim 12, wherein the toner comprises 1 to 20 mass % of the releasing agent, based on a total amount of the toner base particles.

14. The image forming method according to claim 12, wherein the crystalline polyester resin has a melting point of 50° C. to 150° C. where the melting point is defined as a maximum endothermic peak temperature measured through differential scanning calorimetry (DSC).

15. The image forming method according to claim 12, wherein the toner is obtained by a production method comprising:

dissolving or dispersing in an organic solvent toner materials comprising at least the binder resin and the releasing agent to obtain a toner material liquid which is an oil phase, and emulsifying or dispersing the oil phase in an aqueous medium which is an aqueous phase, and removing the organic solvent to form the toner base particles.

16. The image forming method according to claim 12, wherein the releasing agent comprises 60 to 70 mass % of the linear hydrocarbon based on a total amount of hydrocarbons in the releasing agent.

17. The image forming method according to claim 12, wherein the releasing agent has a melting point of 75° C. to 85° C.

18. The image forming method according to claim 12, wherein the toner comprises 1 to 10 mass % of the releasing agent, based on a total amount of the toner base particles.

19. The image forming method according to claim 12, wherein the crystalline polyester resin has a weight average molecular weight (Mw) of 1000 to 6500, a number average molecular weight (Mn) of 500 to 2000, and a ratio Mw/Mn is in a range of 2 to 5.

* * * * *